US011160382B2

(12) United States Patent
Beloff

(10) Patent No.: US 11,160,382 B2
(45) Date of Patent: Nov. 2, 2021

(54) CHAIR SUPPORT ASSEMBLY AND RELATED METHODS OF USE

(71) Applicant: Reid Beloff, Clyde Hill, WA (US)

(72) Inventor: Reid Beloff, Clyde Hill, WA (US)

(73) Assignee: Reid Beloff, Clyde Hill, WA (US)

( * ) Notice: Subject to any disclaimer, the term of this patent is extended or adjusted under 35 U.S.C. 154(b) by 161 days.

(21) Appl. No.: 16/289,442

(22) Filed: Feb. 28, 2019

(65) Prior Publication Data

US 2019/0269248 A1 Sep. 5, 2019

Related U.S. Application Data

(60) Provisional application No. 62/637,660, filed on Mar. 2, 2018, provisional application No. 62/666,029, filed on May 2, 2018.

(51) Int. Cl.
*A47C 7/50* (2006.01)
*A47C 7/52* (2006.01)

(52) U.S. Cl.
CPC ..... *A47C 7/5064* (2018.08); *A47C 7/503* (2013.01); *A47C 7/5062* (2018.08); *A47C 7/5066* (2018.08); *A47C 7/52* (2013.01)

(58) Field of Classification Search
CPC ... A47C 7/5064; A47C 7/5062; A47C 7/5066; A47C 7/503; A47C 7/52
See application file for complete search history.

(56) References Cited

U.S. PATENT DOCUMENTS

| | | | | |
|---|---|---|---|---|
| 315,779 | A | 4/1885 | Haynes | |
| 611,327 | A | 9/1898 | Kelly | |
| 801,398 | A | 10/1905 | Ray | |
| 4,832,407 | A | 5/1989 | Serber | |
| 5,111,909 | A | 5/1992 | Liu | |
| 5,152,581 | A | 10/1992 | Norsworthy | |
| 5,255,957 | A | 10/1993 | Opsvik et al. | |
| 6,634,716 | B2 | 10/2003 | Sander et al. | |
| 7,032,976 | B2 | 4/2006 | Lin | |
| 8,246,118 | B2 | 8/2012 | Moore | |
| 9,642,465 | B1 | 5/2017 | Park | |
| 10,368,651 | B2 * | 8/2019 | Sitek | A47C 16/04 |
| 2006/0082206 | A1 * | 4/2006 | Travis | A47C 9/002 297/423.11 |

FOREIGN PATENT DOCUMENTS

| | | |
|---|---|---|
| FR | 1315510 A | 1/1963 |
| KR | 100 676 208 B1 | 1/2007 |

OTHER PUBLICATIONS

International Search Report and Written Opinion for PCT/US2019/020134, dated Apr. 16, 2019, 20 pages.

* cited by examiner

*Primary Examiner* — Anthony D Barfield
(74) *Attorney, Agent, or Firm* — Seed IP Law Group LLP

(57) ABSTRACT

A chair support assembly is provided which can comprise a bracket assembly having a horizontal bracket and a vertical bracket, the vertical bracket extending from the horizontal bracket at a substantially perpendicular orientation relative to the vertical bracket, and an adjustable arm telescopically coupled to the horizontal bracket, the adjustable arm slideably moveable in a longitudinal direction of the chair support assembly. The chair support assembly can also comprise a shin support assembly slideably coupled to the vertical bracket, the shin support assembly including a shin rest that is sized and shaped to rest against a shin of a user. Related methods of use are also provided.

15 Claims, 34 Drawing Sheets

CHAIR SUPPORT ASSEMBLY AND RELATED METHODS OF USE

BACKGROUND

Technical Field

The present disclosure generally relates to ergonomic posture support assemblies that are removably coupleable to chairs.

Description of the Related Art

By way of background, users sitting on conventional chairs, e.g., office chairs, tend to lack support features that can prevent users from slouching down and/or sliding out of the chair when in the upright or slightly reclined position. In general, it is important for one to have a proper seating posture throughout the day for a healthy work experience. Thus, it is desirable to improve ergonomics associated with chairs and provide appropriate support to users sitting on chairs.

BRIEF SUMMARY

Implementations described herein provide devices, apparatuses, assemblies, and methods with efficient, modular, and robust form factors that improve ergonomics of chairs. In some implementations, the devices, apparatuses, assemblies, and methods described herein allow for users to have enhanced posture support. In some implementations, the devices, apparatuses, assemblies, and methods described herein permit users to effectively swivel chair support assemblies when not in use to provide access to or from the chair, and to conveniently change positions by various swiveling features described herein. Furthermore, the devices, apparatuses, assemblies, and methods described herein can be retrofitted to existing chairs with efficient, modular, and robust form factors.

In one example implementation, a chair support assembly coupleable to a chair can be summarized as including a bracket assembly having a horizontal bracket and a vertical bracket, the vertical bracket extending from the horizontal bracket at a substantially perpendicular orientation relative to the vertical bracket, and an adjustable arm telescopically coupled to the horizontal bracket, the adjustable arm slideably moveable in a longitudinal direction of the chair support assembly. The chair support assembly can also include a shin support assembly slideably coupled to the vertical bracket, the shin support assembly including a shin rest that is sized and shaped to rest against a shin of a user.

In another example implementation, a method can be summarized as including coupling a chair support assembly to a column of a chair, slideably moving an adjustable arm relative to an L-shaped bracket to adjust a longitudinal length of the chair support assembly, and slideably moving a shin support assembly relative to the L-shaped bracket to adjust a vertical length of the chair support assembly, the moving positioning shin rests of the shin support assembly adjacent to shins of a user.

DETAILED DESCRIPTION

In the following description, certain specific details are set forth in order to provide a thorough understanding of various disclosed implementations or embodiments. One skilled in the relevant art will recognize that embodiments or implementations may be practiced without one or more of these specific details. In other instances, well-known structures and devices associated with chairs, fastening, chair supports, and related apparatuses, devices, and methods may not be shown or described in detail to avoid unnecessarily obscuring descriptions of the embodiments or implementations.

Unless the context requires otherwise, throughout the specification and claims which follow, the word "comprise" and variations thereof, such as "comprises" and "comprising," are to be construed in an open, inclusive sense, that is, as "including, but not limited to."

Reference throughout this specification to "one embodiment," "one implementation," "an embodiment," or "an implementation" means that a particular feature, structure or characteristic described in connection with the embodiment or implementation is included in at least one embodiment or implementation. Thus, the appearances of the phrases "in one embodiment," "in one implementation," "in an implementation," or "in an embodiment" in various places throughout this specification are not necessarily all referring to the same embodiment or implementation. Furthermore, the particular features, structures, or characteristics may be combined in any suitable manner in one or more embodiments or implementations.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
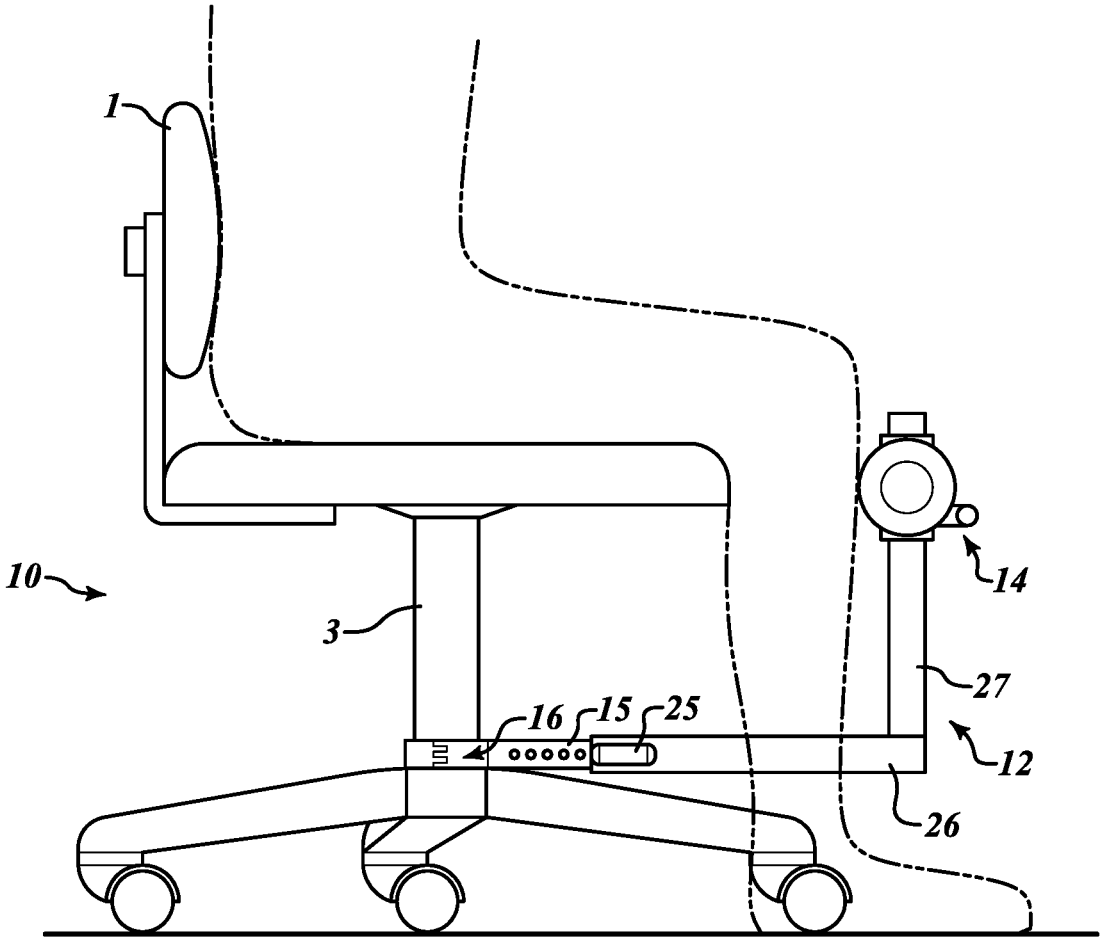
FIG. 1 is a side view of a chair support assembly coupled to a chair, according to one example implementation, illustrating the chair support assembly in an intermediate extended configuration and an intermediate elevated configuration.

FIGS. 1-7 illustrate a chair support assembly 10, according to one example, non-limiting implementation. As illustrated in FIG. 1, the chair support assembly 10 is configured to be removably coupleable to any chair 1.

More particularly, the chair support assembly 10 includes an L-bracket assembly 12, a shin support assembly 14 adjustably coupled to the L-bracket assembly 12, an adjustable arm 15 telescopically coupled to the L-bracket assembly 12, and a clamping member 16 coupled to the adjustable arm 15.

The clamping member 16 includes a first portion 17 hingedly coupled to a second portion 18. The first and the second portions 17, 18 are hingedly coupled to each other to define a column aperture 19. The column aperture 19 is sized and shaped to couple to a column 3 of a chair 1, as illustrated in FIG. 1. In particular, each of the first and second portions 17, 18 includes plate members 20, 21, respectively. The plate members 20, 21 are spaced apart and include pin apertures 22 extending therethrough. The pin apertures 22 are sized and shaped to coupleably receive a pin, or any other fastening member. Thus, when coupled to the chair 1, the second portion 18, for example, can be hingedly moved to allow column 3 of the chair 1 to be received in the column aperture 19. The second portion 18, thereafter, can be hingedly rotated to secure the column 3 of the chair 1 in the column aperture 19. A pin or any other fastening member can be received through the pin apertures 22 to couple to the column 3 of the chair 1. In some implementations, the first portion 17 can include an integral pin that is positioned near an edge of the first portion 17 that couples to the second portion 18. Such an integral pin can be rotatable relative to the edge to couple to the second portion 18 when the clamping member 16 is secured to the column 3.

As described above, the clamping member 16 is coupled to the adjustable arm 15. In particular, the first portion 17 has a substantially C-shaped structure with a connecting portion 23 that is secured to the adjustable arm 15. The connecting portion 23, in some implementations, can be fastened, welded to the adjustable arm 15, or can be formed as an integral component with the adjustable arm 15. The adjustable arm 15 has a substantially square-shaped structure with a plurality of arm apertures 24 extending through at least a side of the adjustable arm 15. The adjustable arm 15 may alternatively have other profiled structures, such as round, etc. Each of the arm apertures 24 is sized and shaped to receive therethrough portions of a longitudinal adjustment pin 25.

Figure 2:
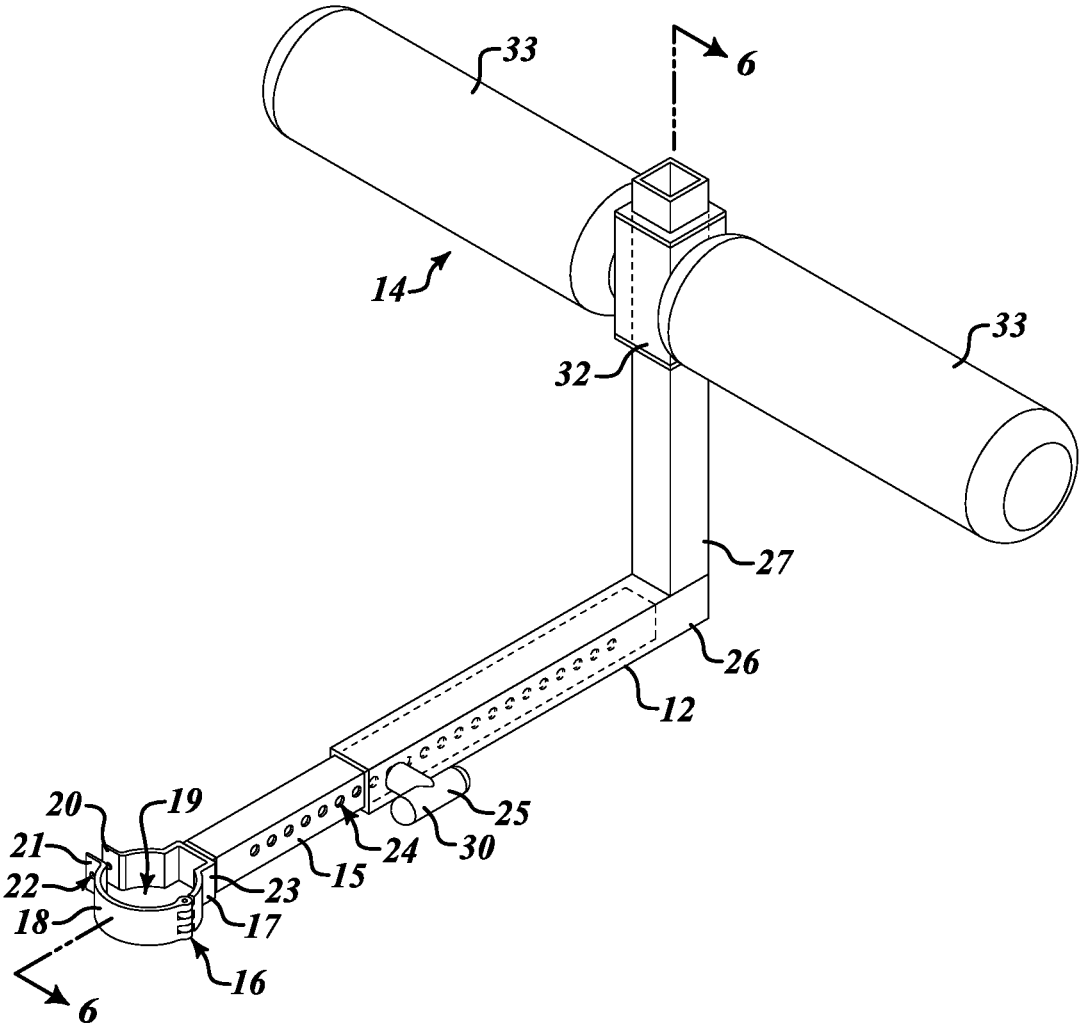
FIG. 2 is a top isometric view of the chair support assembly of FIG. 1 in the intermediate extended configuration and the intermediate elevated configuration.
Figure 3:
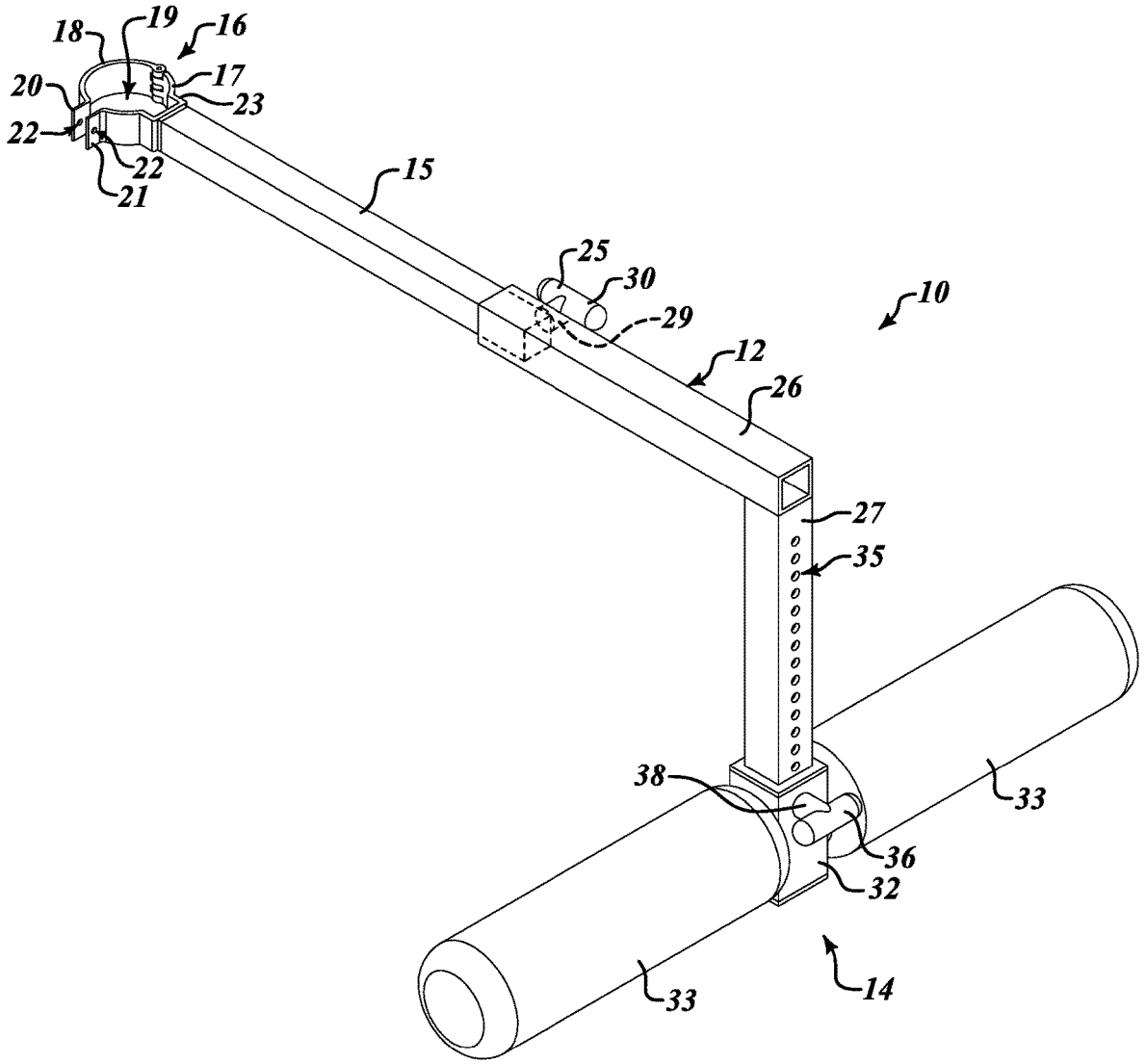
FIG. 3 is a bottom, inverted isometric view of the chair support assembly of FIG. 1 in an extended configuration and an elevated configuration.
Figure 4:
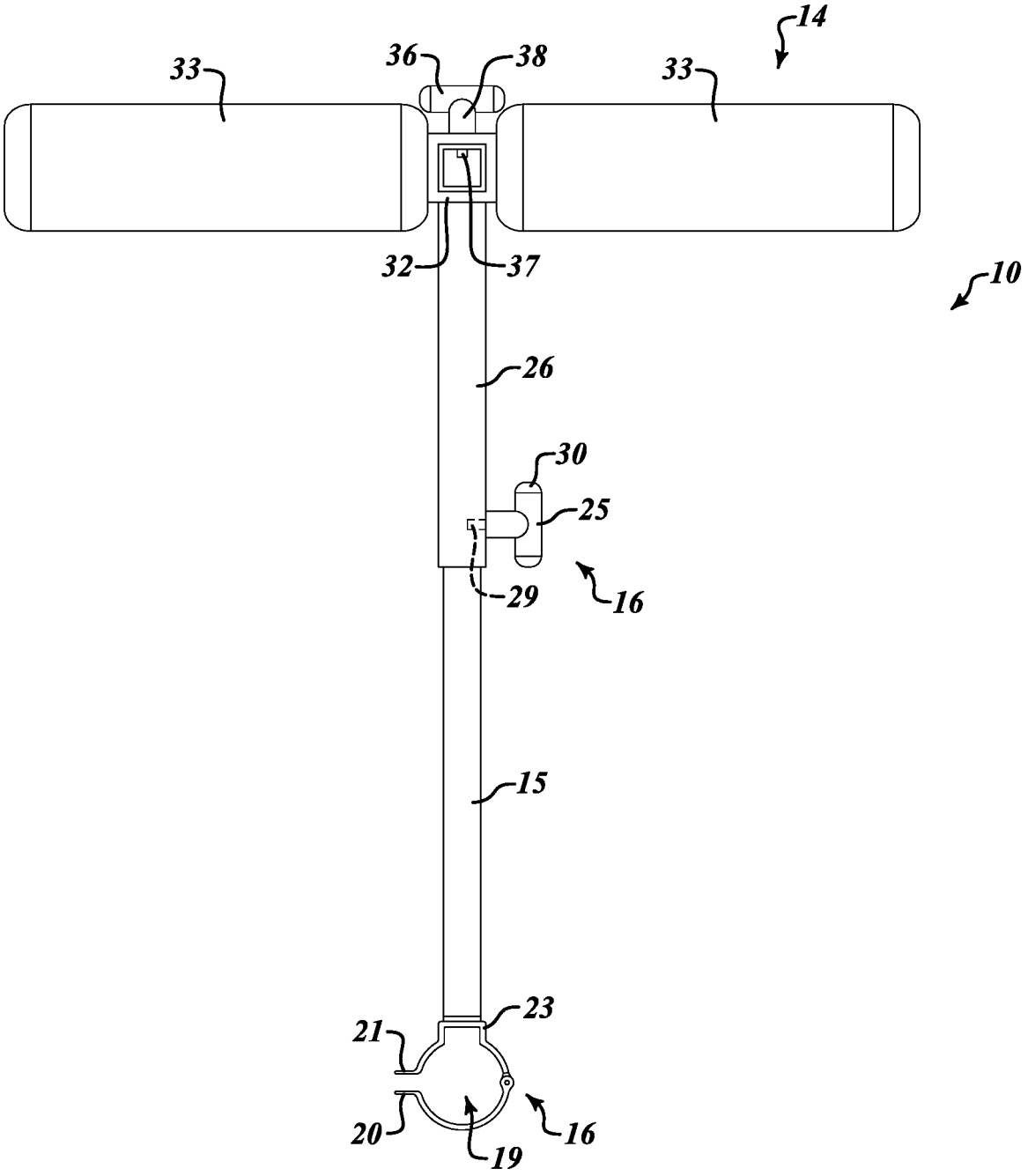
FIG. 4 is a top plan view of the chair support assembly of FIG. 1 in the extended configuration and the elevated configuration.
Figure 5:
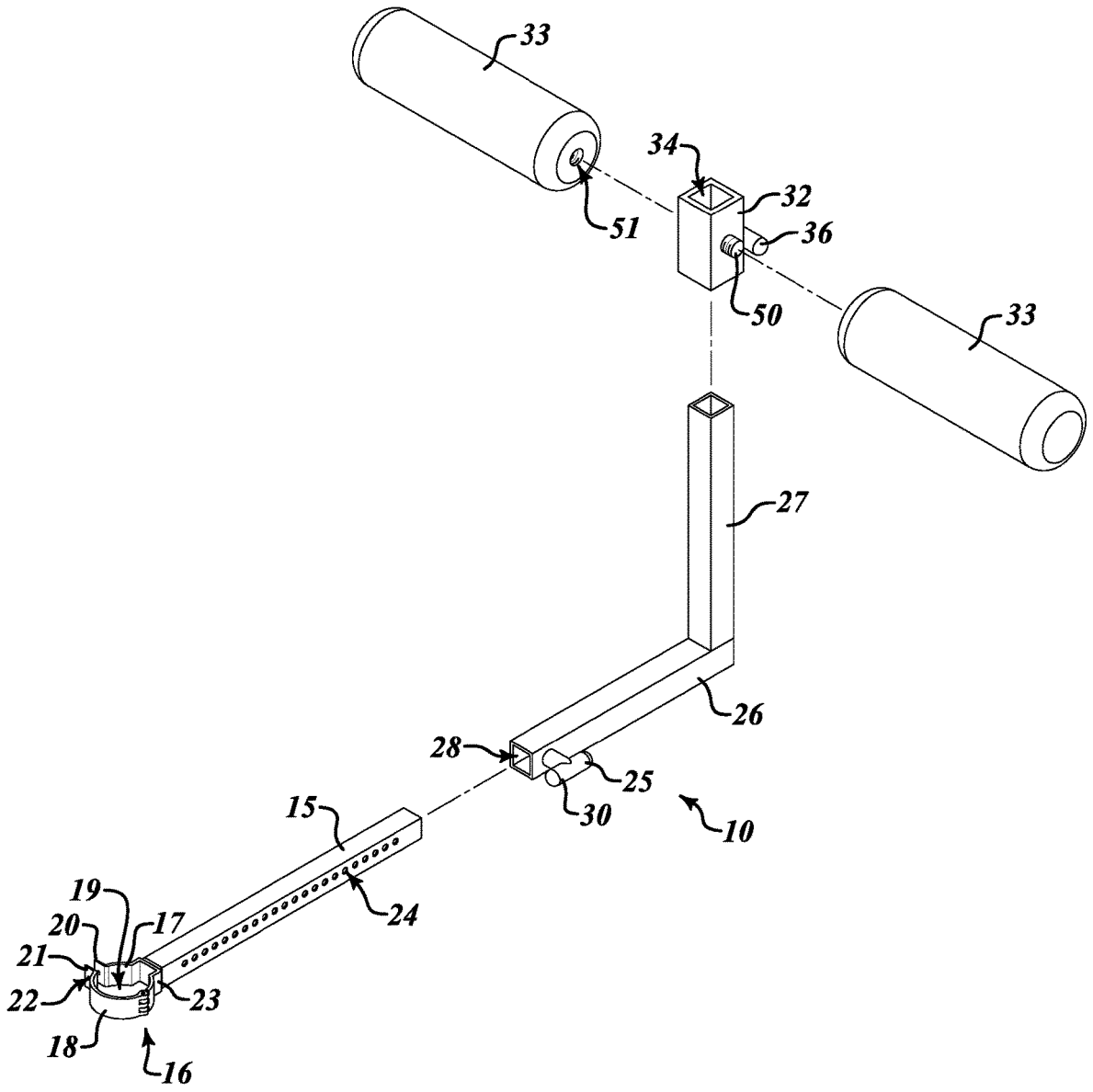
FIG. 5 is an exploded view of the chair support assembly of FIG. 1.
Figure 6:
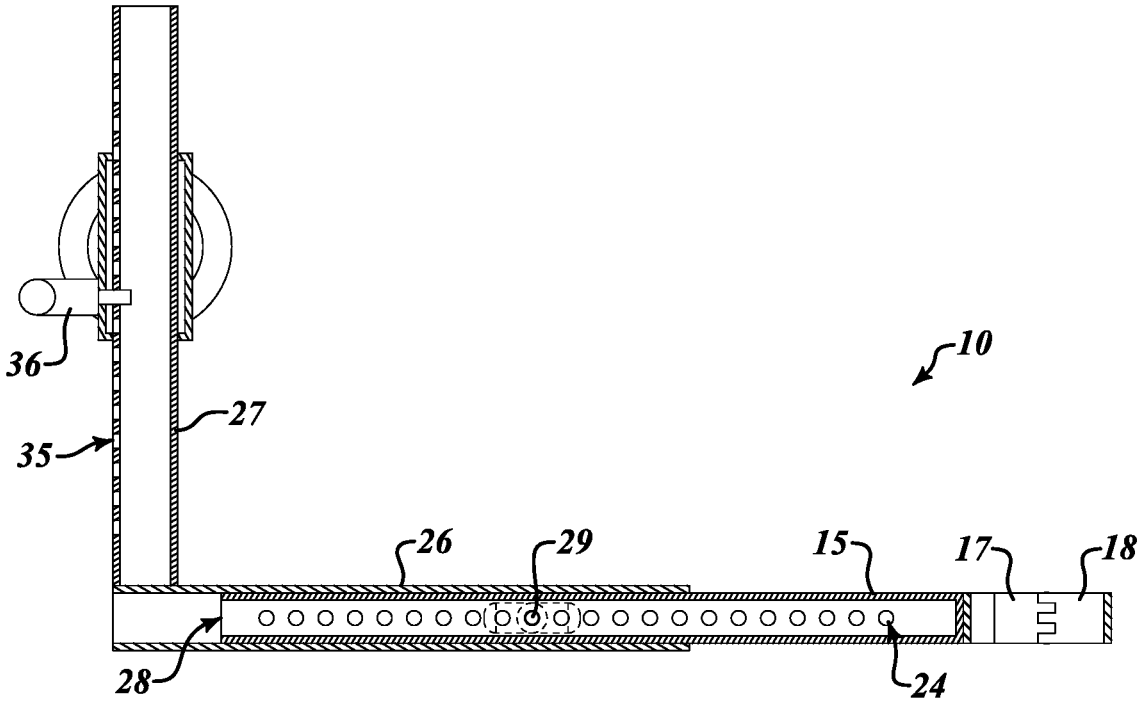
FIG. 6 is a cross-sectional view of the chair support assembly of FIG. 1 in the intermediate extended configuration and the intermediate elevated configuration, taken along lines 6-6.
Figure 7:
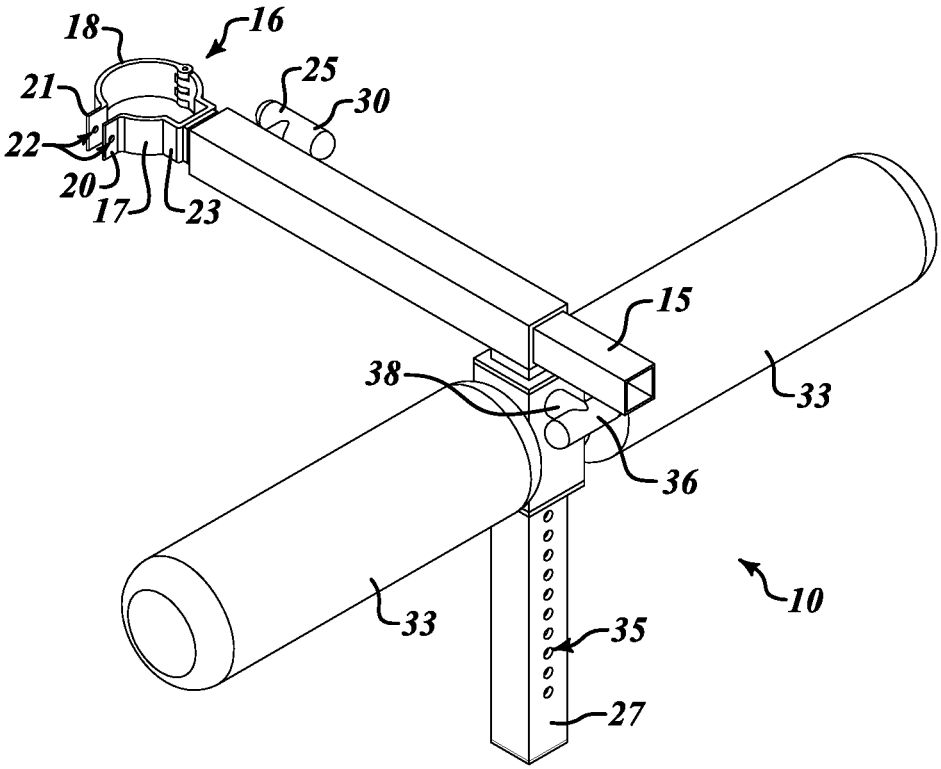
FIG. 7 is a bottom, inverted isometric view of the chair support assembly of FIG. 1 in a retracted configuration and a lowered configuration.

In particular, the adjustable arm 15 is sized and shaped to be telescopically received in the L-bracket assembly 12. The L-bracket assembly 12 includes a horizontal bracket 26 coupled to a vertical bracket 27. In some implementations, the horizontal bracket 26 can be coupled to the vertical bracket 27 via fastening, welding, or other fastening structures. In some implementations, the horizontal bracket 26 and the vertical bracket 27 can be formed as an integral component. The horizontal bracket 26 has a substantially square-shaped structure that is hollow, having an arm cavity 28. The horizontal bracket 27 may alternatively have other profiled structures, such as round, etc. The arm cavity 28 is sized and shaped to slideably receive therein the adjustable arm 15. Thus, a longitudinal length of the chair support assembly 10 can be adjustable by sliding the adjustable arm 15 in the arm cavity 28, with the arm apertures 24 positioned to vary the longitudinal length of the chair support assembly 10. For example, FIGS. 1, 2, and 6 illustrate the adjustable arm 15 in an intermediate extended configuration of the chair support assembly 10, with one of the plurality of arm apertures 24 coupleably receiving the longitudinal adjustment pin 25. FIGS. 3 and 4 illustrate the adjustable arm 15 in a substantially extended configuration, with another one of the plurality of arm apertures 24 coupleably receiving the longitudinal adjustment pin 25. FIG. 7 illustrates a fully retracted configuration of the chair support assembly 10, with another one of the plurality of arm apertures 24 coupleably receiving the longitudinal adjustment pin 25.

The longitudinal adjustment pin 25 can take a wide variety of forms and shapes. For example, in some implementations, the longitudinal adjustment pin 25 can include a shaft portion 29 that is moveable via a housing 30 of the longitudinal adjustment pin 25. For example, rotating the housing 30 may extend or retract the shaft portion 29 in or out of any one of the arm apertures 24. For example, in some implementations, the longitudinal adjustment pin 25 may take the form of a quick pin. In such an implementation, the shaft portion 29 may include a biasing spring that urges the shaft portion toward the adjustment arm 15. Moving or retracting the housing 30 away from the horizontal bracket 26 can cause the biasing forces to be overcome and the shaft portion 29 to retract and move out of the arm apertures 24. Such can allow the adjustable arm 25 to be slideably moved until a desired positioning of the adjustable arm 25 relative to the vertical bracket 27 is reached, at which point the biasing spring can move the shaft portion 29 in or through the arm apertures 24.

As illustrated in FIGS. 1-7, the L-bracket assembly 12 includes the horizontal bracket 26 coupled to the vertical bracket 27 to form a substantially L-shaped structure. In particular, the vertical bracket 27 extends vertically from the horizontal bracket 26 and is oriented perpendicularly relative to the horizontal bracket 26. In particular, such perpendicular orientation is advantageous to improve ergonomics of the chair 1. For example, Applicant has discovered that other non-perpendicular orientations fail to adequately provide firm support to a user sitting on the chair 1, and can, for example, lead to the user slouching and/or sliding out of the chair. In particular, the shin support assembly 14 is adjustably coupled to the vertical bracket 27 and is sized and shaped to firmly rest against shins of a user, as illustrated in FIG. 1.

The shin support assembly 14 includes a mounting bracket 32 and a pair of shin rests 33, with each shin rest 33 extending outwardly from the mounting bracket 32. The shin rests 33, in some implementations, can be coupled to the mounting bracket 32 via fastening, welding, adhering, or other appropriate fastening structures. In some implementations, the mounting bracket 32 can include studs 50 protruding from sides of the mounting bracket 32. The studs 50 are sized and shaped to threadedly couple to the shin rests 33 via coupling apertures 51. The shin rests 33 have a generally cylindrical shape and can comprise rubber, plastic, or other suitable material that supports shins of the user. The mounting bracket 32 has a body that is generally hollow with a bracket opening 34. The bracket opening 34 is sized and shaped to slideably receive therein the vertical bracket 27.

As illustrated in FIG. 3 in detail, for example, a side of the vertical bracket 27 includes a plurality of rest apertures 35. Each of the rest apertures 35 is sized and shaped to receive therethrough portions of a vertical adjustment pin 36. The vertical adjustment pin 36 can also take a wide variety of forms and can be similar to the longitudinal adjustment pin 25. For example, in some implementations, the vertical adjustment pin 36 can include a shaft portion 37 that is moveable via a housing 38 of the vertical adjustment pin 36. For example, rotating the housing 38 may extend or retract the shaft portion 37 in or out of any one of the rest apertures 35. For example, in some implementations, the vertical adjustment pin 36 may take the form of a quick pin. In such an implementation, the shaft portion 37 may include a biasing spring that urges the shaft portion 37 toward the vertical bracket 27. Moving the housing 38 away from the vertical bracket 27 can cause the biasing forces to be overcome and the shaft portion 37 to retract and move out of the rest apertures 35. Such can allow the vertical adjustment pin 36 to be slideably moved until a desired positioning of the vertical adjustment pin 36 relative to the vertical bracket 27 is reached, at which point the biasing spring can move the shaft portion 37 in or through the rest apertures 35.

Thus, in this manner, the shin rests 33 can be vertically adjusted to facilitate supporting shins of users with varying heights. For example, FIGS. 1, 2, and 6 illustrate the shin support assembly 14 in an intermediate elevated configuration. A vertical length of the chair support assembly 10 can be adjustable by sliding the mounting bracket 32 over the vertical bracket 27, with the rest apertures 35 positioned to vary the vertical length of the chair support assembly 10. For example, FIG. 3 illustrates the shin support assembly 14 in a fully elevated configuration, wherein one of the plurality of rest apertures 35 coupleably receives the vertical adjustment pin 36. FIG. 7 illustrates a fully lowered configuration of the chair support assembly 10, with another one of the plurality of rest apertures 35 coupleably receiving the vertical adjustment pin 36.

Thus, in use, a user can couple the clamping member 16 to the column 3 of the chair 1. As described above, the second portion 18 can be hingedly moved relative to the first portion 17 to secure the clamping member 16 to the column 3 of the chair 1. The longitudinal length of the chair support assembly 10 can be adjusted by slideably, telescopically moving the adjustable arm 15 until a desired longitudinal positioning is reached, at which point the longitudinal adjustment pin 25 can secure the adjustable arm 15 to the horizontal bracket 26 of the L-bracket assembly 12. Thereafter, as desired, the vertical length of the chair support assembly 10 can be adjusted via slideably, telescopically moving the shin support assembly 14 until a desired position of the shin rests 33 is reached, where the user's shins are supported by the shin rests 33.

Figure 8:
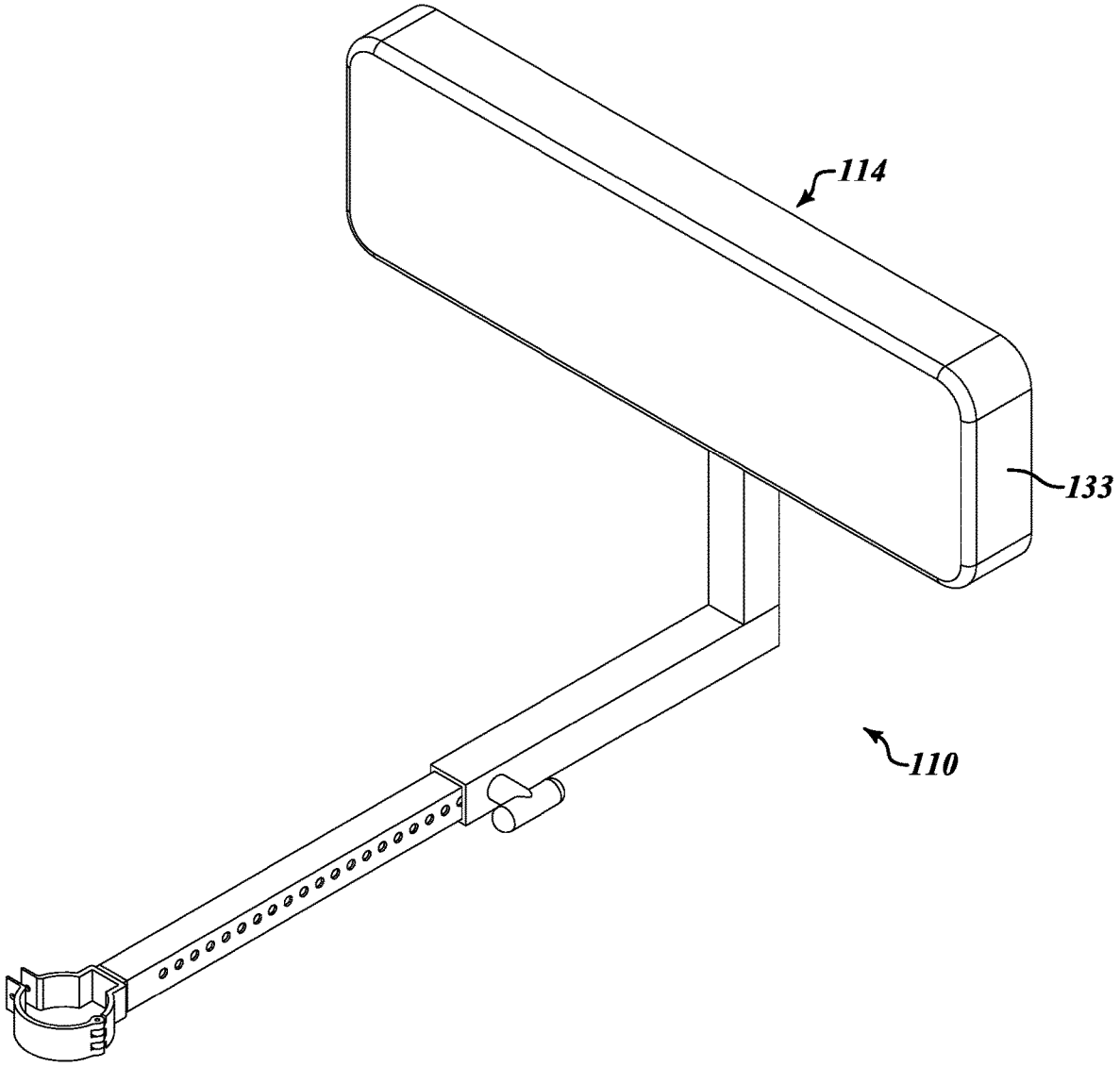
FIG. 8 is a top isometric view of a chair support assembly, according to another example implementation, illustrating the chair support assembly in an extended configuration and an elevated configuration.
Figure 9:
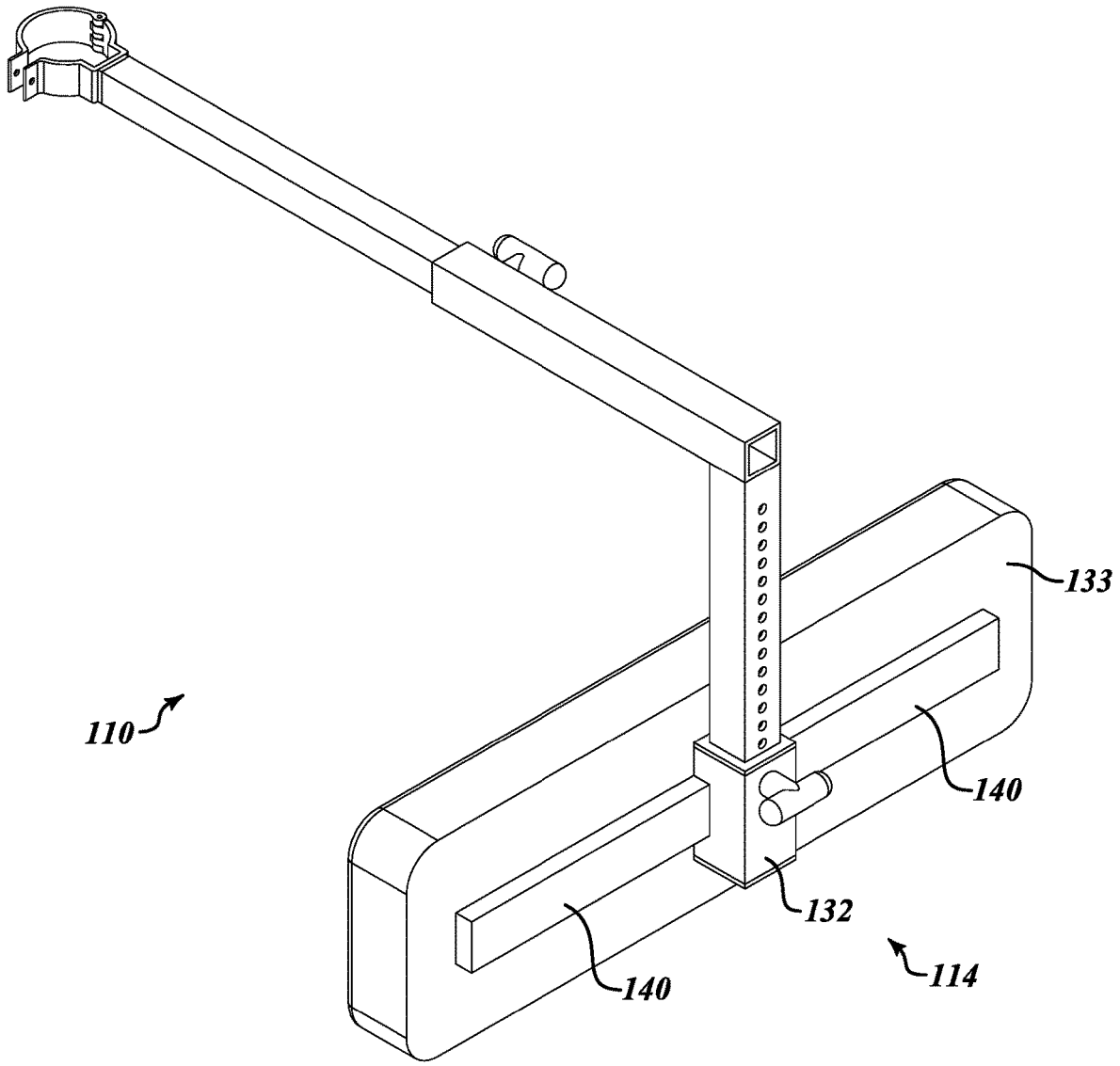
FIG. 9 is a bottom, inverted isometric view of the chair support assembly of FIG. 8 in the extended configuration and the elevated configuration.

FIGS. 8 and 9 illustrate a chair support assembly 110, according to another example, non-limiting implementation. The chair support assembly 110 is generally similar to the chair support assembly 10, but provides a variation in a shin support assembly 114. The shin support assembly 114 is generally similar to the shin support assembly 14 but includes a shin pad 133 and a pair of supporting plates 140. The supporting plates 140 are coupled to a mounting bracket 132 of the shin support assembly 114 and extend outwardly therefrom. The shin pad 133 is coupled to adjacent faces of the supporting plates 140. Although FIGS. 8 and 9 illustrate the chair support assembly 110 in an extended configuration and an elevated configuration, as described above, the chair support assembly 110 can be longitudinally and vertically adjusted similar to the chair support assembly 10.

Figure 10:
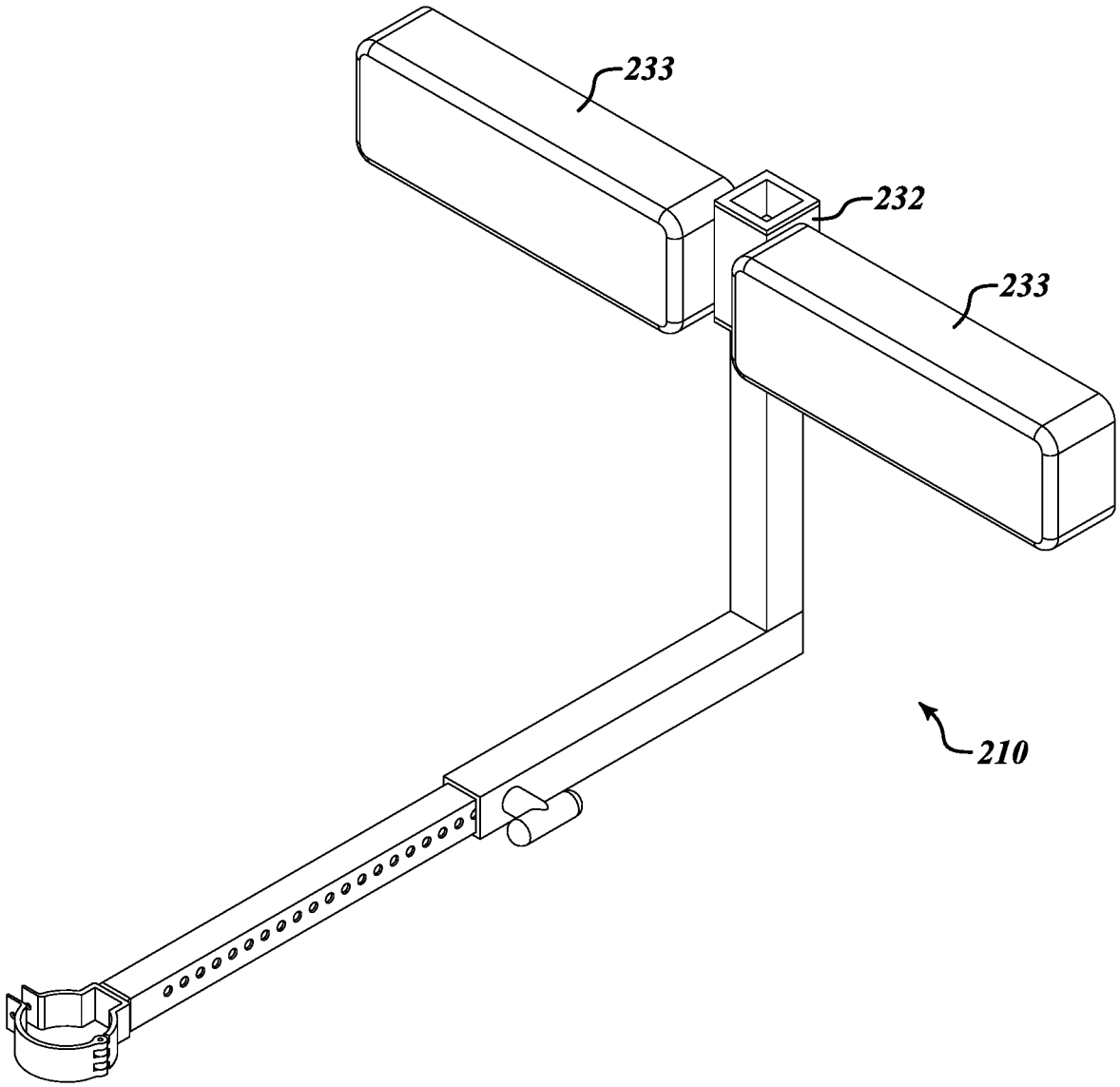
FIG. 10 is a top isometric view of a chair support assembly, according to another example implementation, illustrating the chair support assembly in an extended configuration and an elevated configuration.
Figure 11:
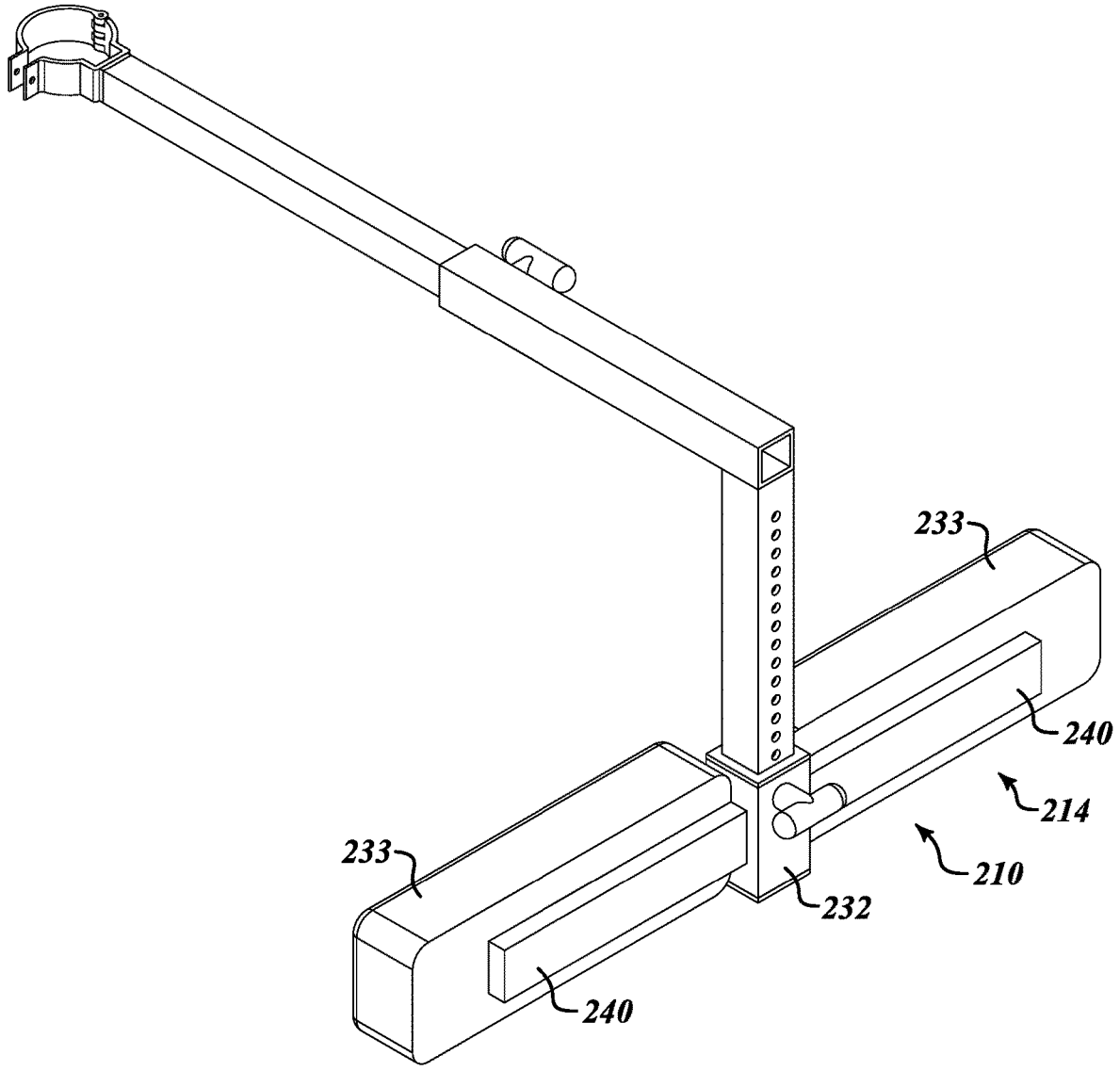
FIG. 11 is a bottom, inverted isometric view of the chair support assembly of FIG. 10 in the extended configuration and the elevated configuration.

FIGS. 10 and 11 illustrate a chair support assembly 210, according to another example, non-limiting implementation. The chair support assembly 210 is generally similar to the chair support assembly 10, but provides a variation in a shin support assembly 214. The shin support assembly 214 is generally similar to the shin support assembly 14 but includes a pair of shin pads 233 that have a substantially rectangular shape in lieu of the cylindrical shape of the shin rests 33, and supporting plates 240 coupled to a mounting bracket 232. Again, although FIGS. 10 and 11 illustrate the chair support assembly 210 in an extended configuration and an elevated configuration, as described above, the chair support assembly 210 can be longitudinally and vertically adjusted similar to the chair support assembly 10.

Figure 12:
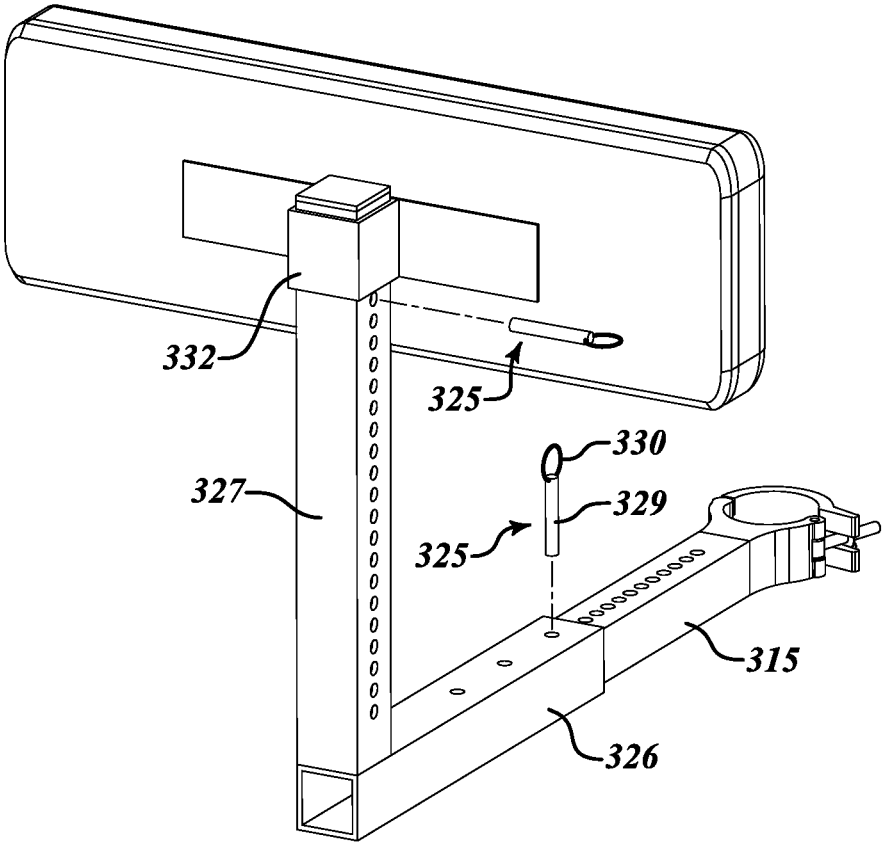
FIG. 12 is a perspective view of a chair support assembly, illustrating an adjustment pin, according to another example implementation.

FIGS. 12 and 13A-13C illustrate various alternative, example implementations of adjustment pins. For example, FIG. 12 illustrates a pair of adjustment pins 325, according to one example implementation. The adjustment pin 325 includes a shaft 329 and a ring member 330 coupled to the shaft 329. As described above, adjustment pins can take the form of a longitudinal adjustment pin, e.g., longitudinal adjustment pin 25, or a vertical adjustment pin, e.g., vertical adjustment pin 36. Thus, the adjustment pin 325 can couple an adjustment arm 315 to a horizontal bracket 326, and/or couple a mounting bracket 332 to a vertical bracket 327.

Figure 13A:
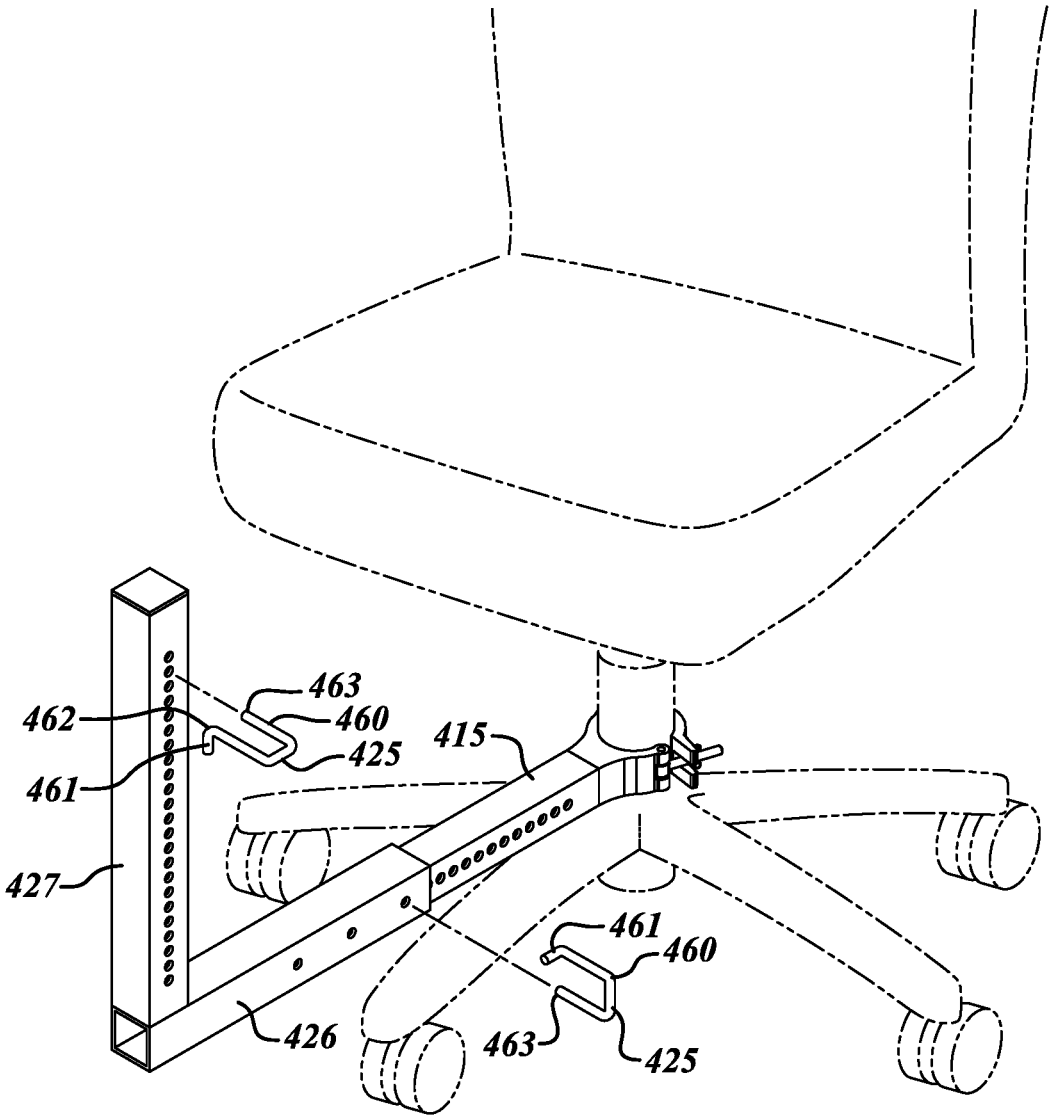
FIGS. 13A-13C are perspective views of a chair support assembly, illustrating various configurations of an adjustment pin, according to another example implementation.
Figure 13B:
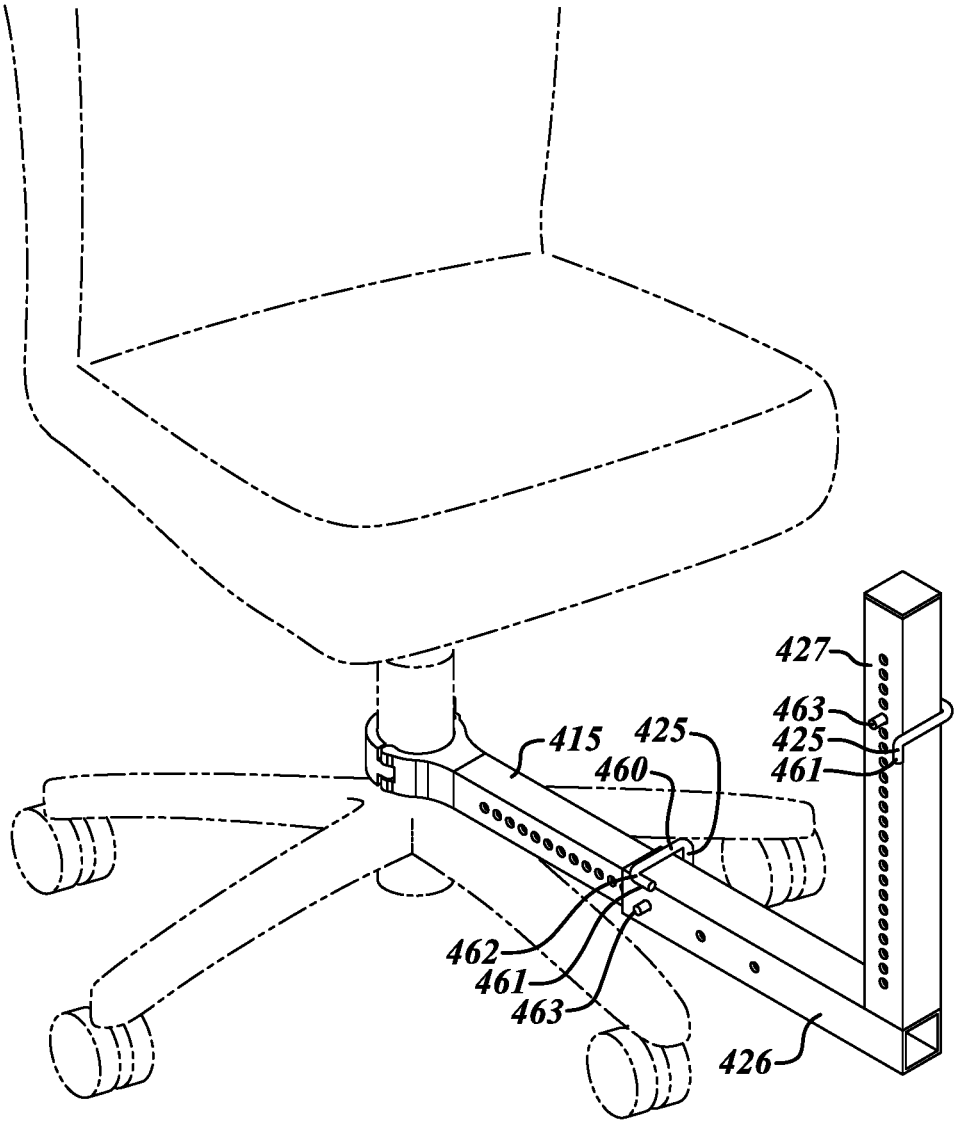
Figure 13C:
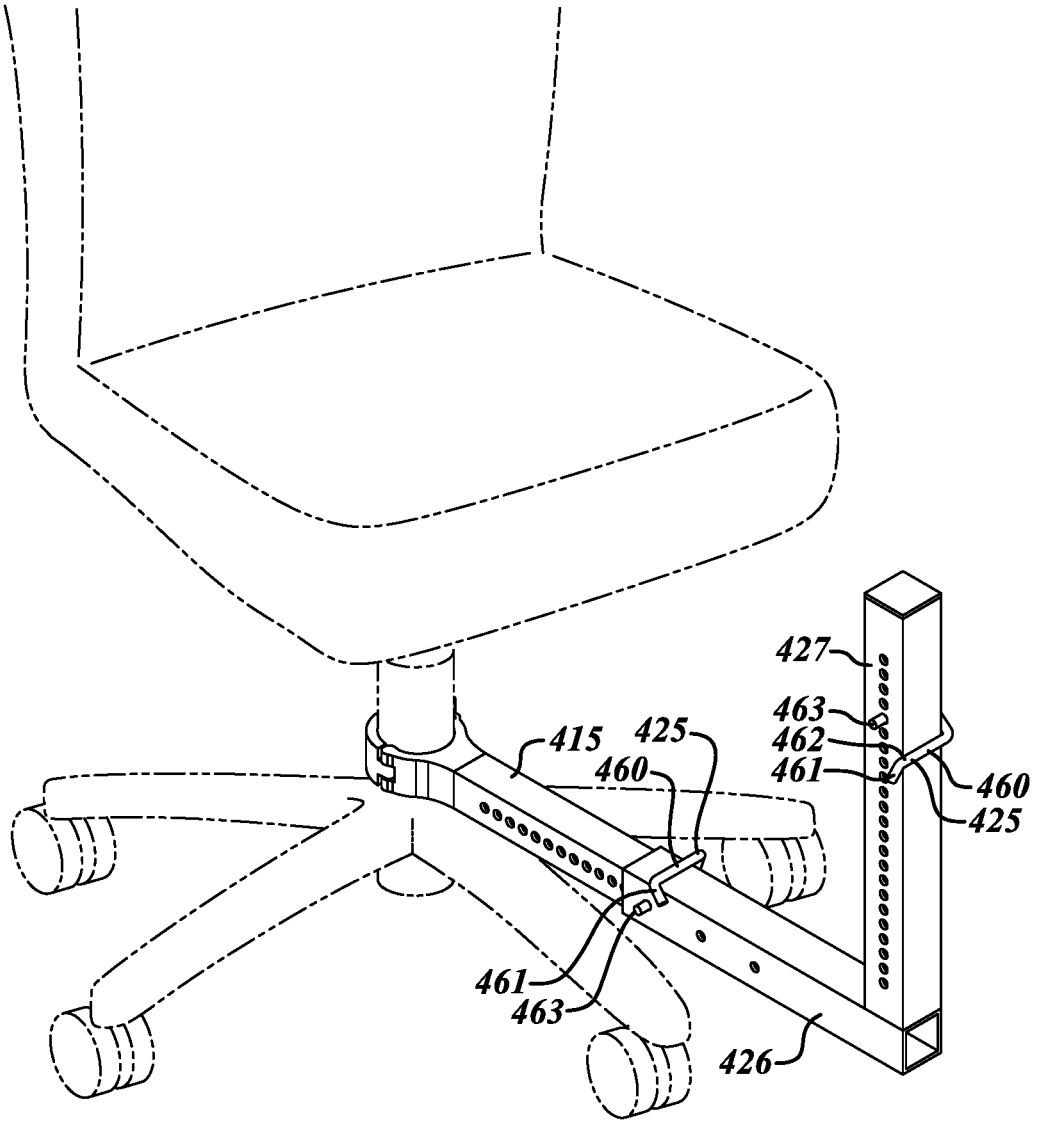

FIGS. 13A-13C illustrate perspective views of a pair of adjustment pins 425 according to one example implementation, in various configurations. In particular, FIG. 13A illustrates adjustment pins 425 in a pre-installation configuration, e.g., prior to coupling to corresponding horizontal bracket 426 or vertical bracket 427. FIG. 13B illustrates adjustment pins 425 in an intermediate installation configuration. FIG. 13C illustrates adjustment pins 425 in an installed configuration. The adjustment pin 425 has a u-shaped flange 460 and a lower flange 461 which extends perpendicularly relative to an end 462 of the u-shaped flange 460. During installation, an end 463 is inserted through apertures of the vertical bracket 427 and mounting bracket (not shown for clarity of description and illustration) and apertures of the horizontal bracket 426 and adjustment arm 415. Thereafter, the adjustment pin 425 is rotated such that the lower flange 461 abuts the corresponding vertical bracket 427 or horizontal bracket 426 in the installed configuration.

Figure 14:
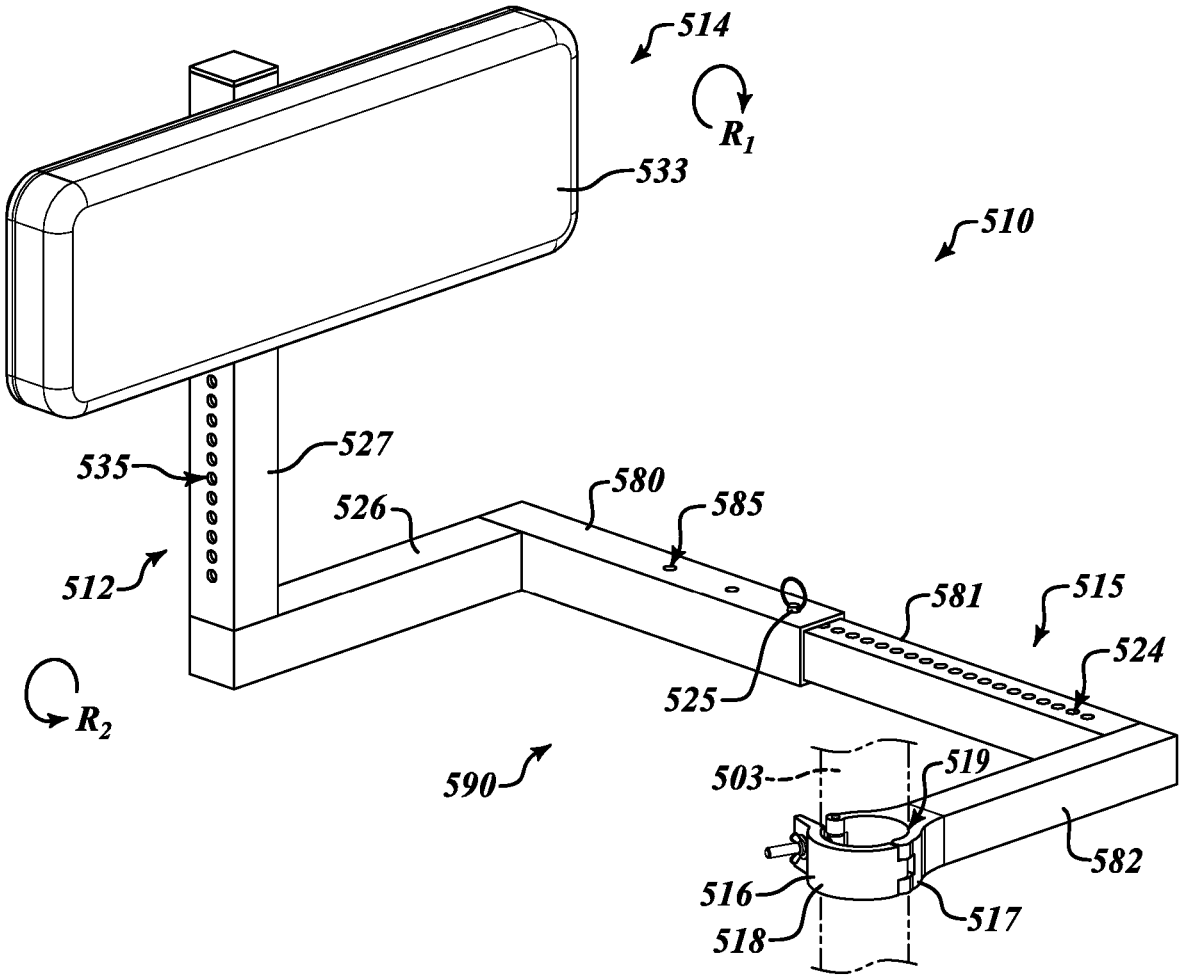
FIG. 14 is a front, skewed isometric view of a chair support assembly, according to another example implementation, the chair support assembly in a partially extended configuration and a partially elevated configuration.
Figure 15:
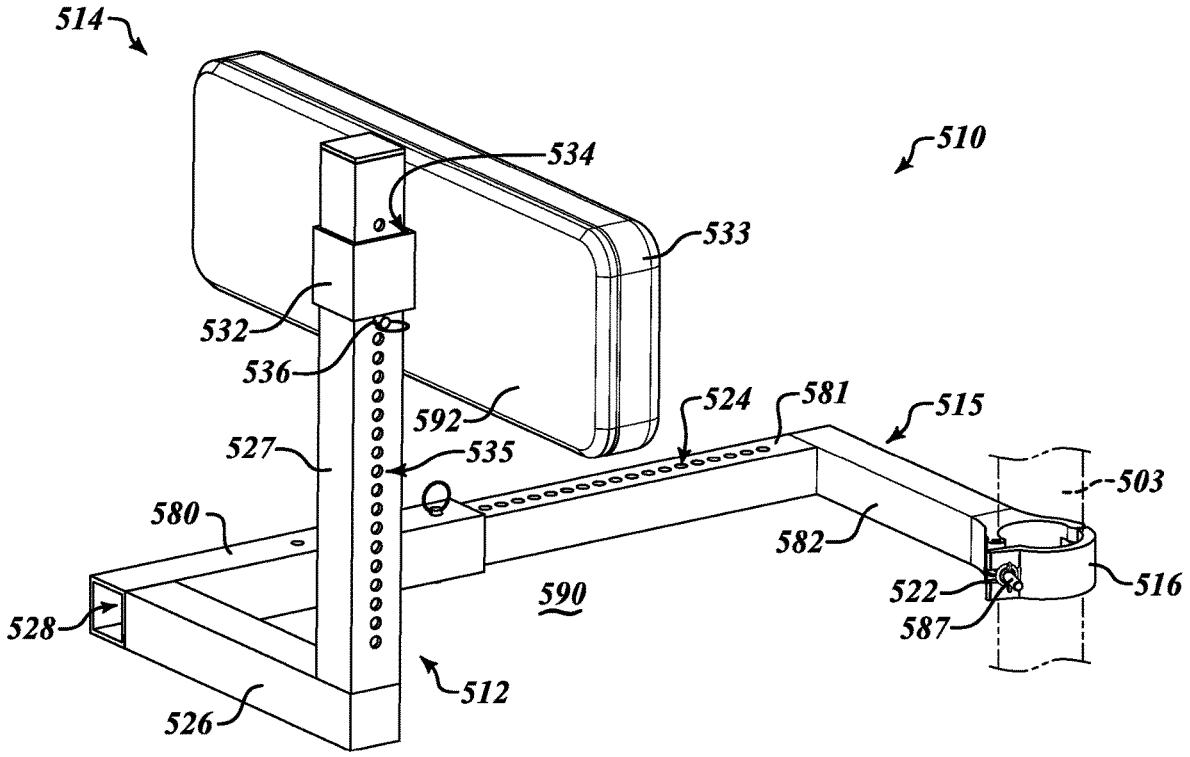
FIG. 15 is a rear, skewed isometric view of the chair support assembly of FIG. 14.

FIGS. 14 and 15 illustrate a chair support assembly 510, according to another example, non-limiting implementation, in a partially extended configuration and a partially elevated configuration. The chair support assembly 510 can be fully extended, fully retracted, fully elevated, or fully lowered similar to the implementations of the chair support assemblies described above. The chair support assembly 510 is generally similar to the various implementations of the chair support assemblies described herein but provides certain variations. The chair support assembly 510 includes an L-bracket assembly 512, a shin support assembly 514 adjustably coupled to the L-bracket assembly 512, an adjustable arm assembly 515 telescopically coupled to the L-bracket assembly 512, and a clamping member 516 coupled to the adjustable arm assembly 515.

The L-bracket assembly 512 includes a vertical bracket 527, a first horizontal bracket 526, and a second horizontal bracket 580. The L-bracket assembly 512 provides a variation, in that, the first horizontal bracket 526 extends in a perpendicular direction to the vertical bracket 527 in a lateral direction. By contrast, the horizontal bracket 26 of the chair support assembly 10, for example, extends in a longitudinal direction. The first horizontal bracket 526 includes a plurality of rest apertures 535. The second horizontal bracket 580 extends in a perpendicular direction to the first horizontal bracket 526 in the longitudinal direction and includes an arm cavity 528 and a plurality of pin apertures 585.

The shin support assembly 514 includes a mounting bracket 532 coupled to a support plate 592 and a shin rest 533, with the shin rest 533 coupled to the support plate 592. The mounting bracket 532 has a body that is generally hollow with a bracket opening 534. The bracket opening 534 is sized and shaped to slideably receive therein the vertical bracket 527. Moreover, in this implementation, the shin support assembly 514 is adjustably mounted to the vertical bracket 527. In particular, a vertical adjustment pin 536 is coupleably received in the vertical bracket 527 via one of the rest apertures 535, which set a height of the chair support assembly 510. The mounting bracket 532 rests against the vertical adjustment pin 536 when a desired height of the chair support assembly 510 is selected. The vertical adjustment pin 536 in this implementation takes the form of a quick pin, but can take other forms of the various pins described herein.

The adjustable arm assembly 515 provides a variation, in that, it includes an adjustable arm 581 coupled to an extension bracket 582. The extension bracket 582 extends in a perpendicular direction to the adjustable arm 581 in the lateral direction and includes a plurality of arm apertures 524. As illustrated in FIGS. 14 and 15, the adjustable arm 581 is movably and telescopically received in the second horizontal bracket 580 via the arm cavity 528 disposed in the second horizontal bracket 580. The adjustable arm 581 can be adjustably coupled to the second horizontal bracket 580 in the longitudinal direction via a longitudinal adjustment pin 525. In this implementation, the adjustable pin 525 is in the form of a quick pin, but can take other forms of adjustable pins described above. In particular, a longitudinal length of the chair support assembly 510 can be adjusted by coupling the longitudinal adjustment pin to the second horizontal bracket 580 via one of the pin apertures 585 and the adjustable arm 581 via one of the arm apertures 524 when a desired length of the chair support assembly 510 is set. The extension bracket 582 at one end is coupled to the adjustable arm 581 and at another, opposite end includes the clamping member 516 coupled thereto.

The clamping member 516 includes a first portion 517 hingedly coupled to a second portion 518. The first and the second portions 517, 518 are hingedly coupled to each other to define a column aperture 519. The column aperture 519 is sized and shaped to rotatably couple to a column 503, for example, column 3 of a chair 1, illustrated in FIG. 1. As illustrated in FIGS. 14 and 15, the first portion 517 includes a pin 587 extending outwardly therefrom, which is coupleably received in a pin aperture 522 disposed in the second portion 518.

As illustrated in FIGS. 14 and 15, the first horizontal bracket 526 of the L-bracket assembly 512 and the extension bracket 582 are offset laterally relative to the column 503 of a chair received in the column aperture 519 to define a feet resting region 590. The feet resting region 590 is sized and shaped to provide a region wherein the feet of a user can be positioned such that the shins of the user are rested against the shin support assembly 514. More particularly, the feet resting region 590 allows for the chair support assembly 510 to be rotatably moved about the column 503 of the chair via the clamping member 516. For example, when the chair support assembly 510 is coupled to the column 503 of the chair, the user may rotate the chair support assembly 510 in a first rotary direction R1 such that the shin support assembly 514 is rotated away from the shins of the user. In this manner, the chair support assembly 510 may be moved to allow the user ease of moving away from the chair. Conversely, the chair support assembly 510 may be rotatably moved in a second rotary direction R2 to bring the shin support assembly 514 toward the shins of the user during use. Thus, in this manner, this implementation of the chair support assembly 510 can facilitate ease of access to and away from the chair during use.

Figure 16:
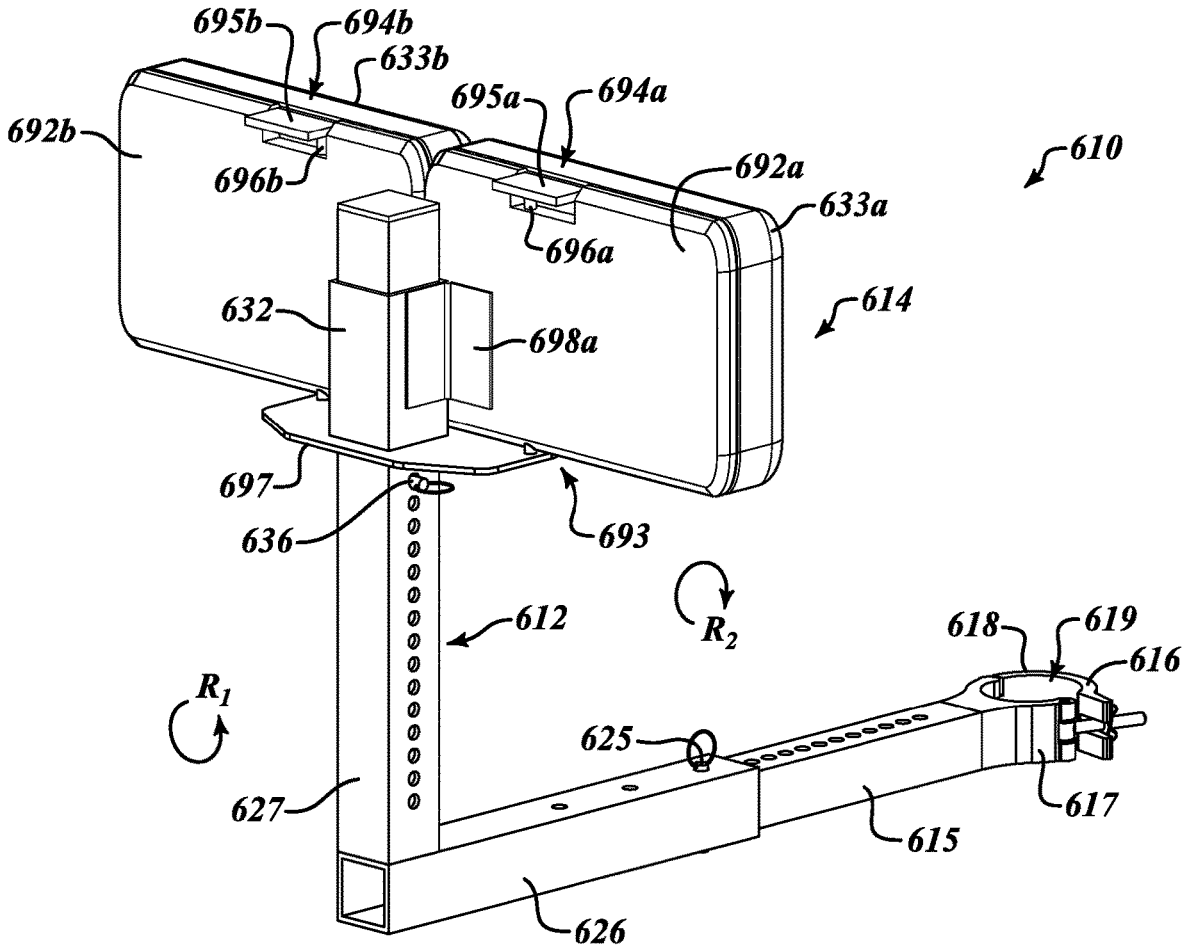
FIG. 16 is a right side isometric view of a chair support assembly, according to another example implementation, the chair support assembly in a partially extended configuration and a partially elevated configuration.
Figure 17:
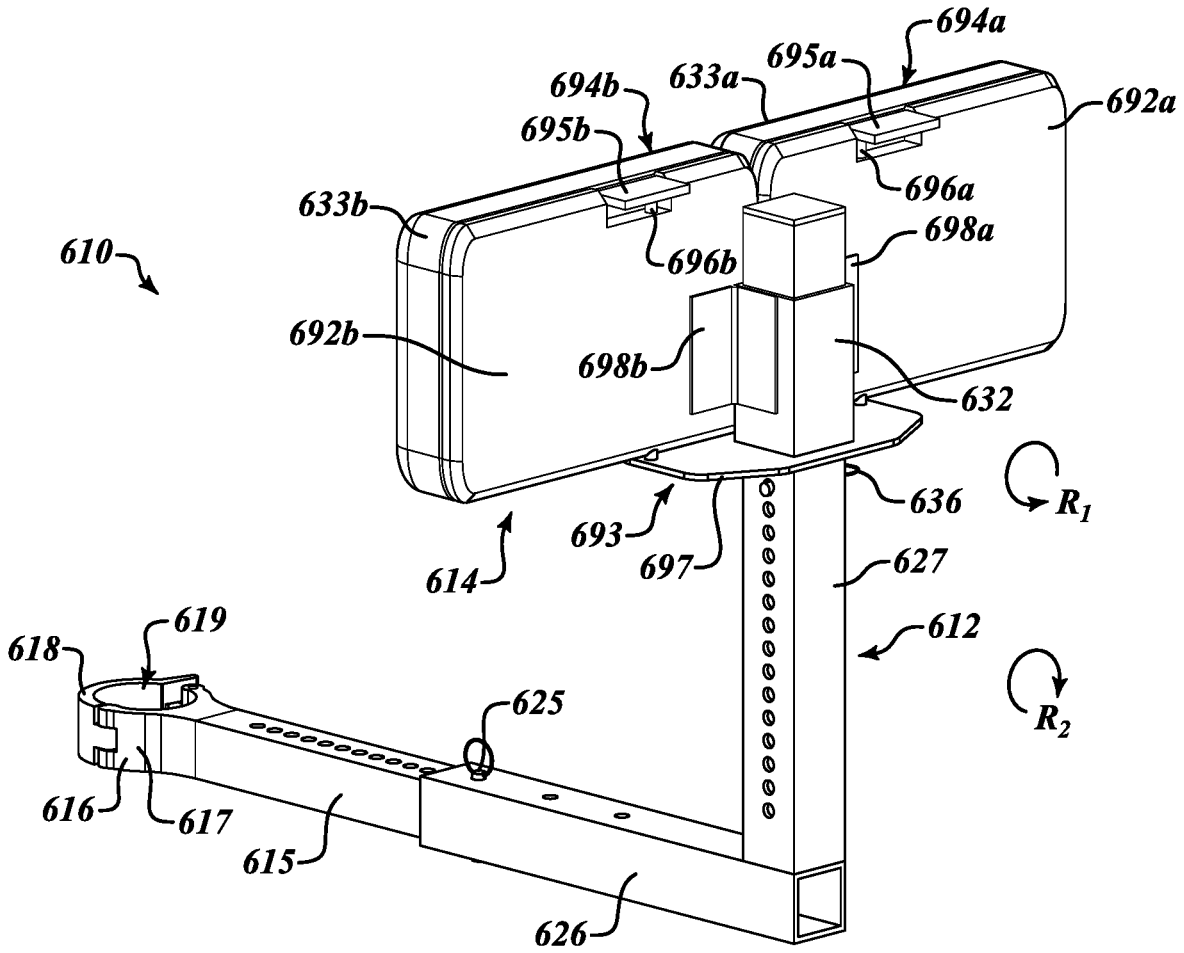
FIG. 17 is a left side isometric view of the chair support assembly of FIG. 16.
Figure 18:
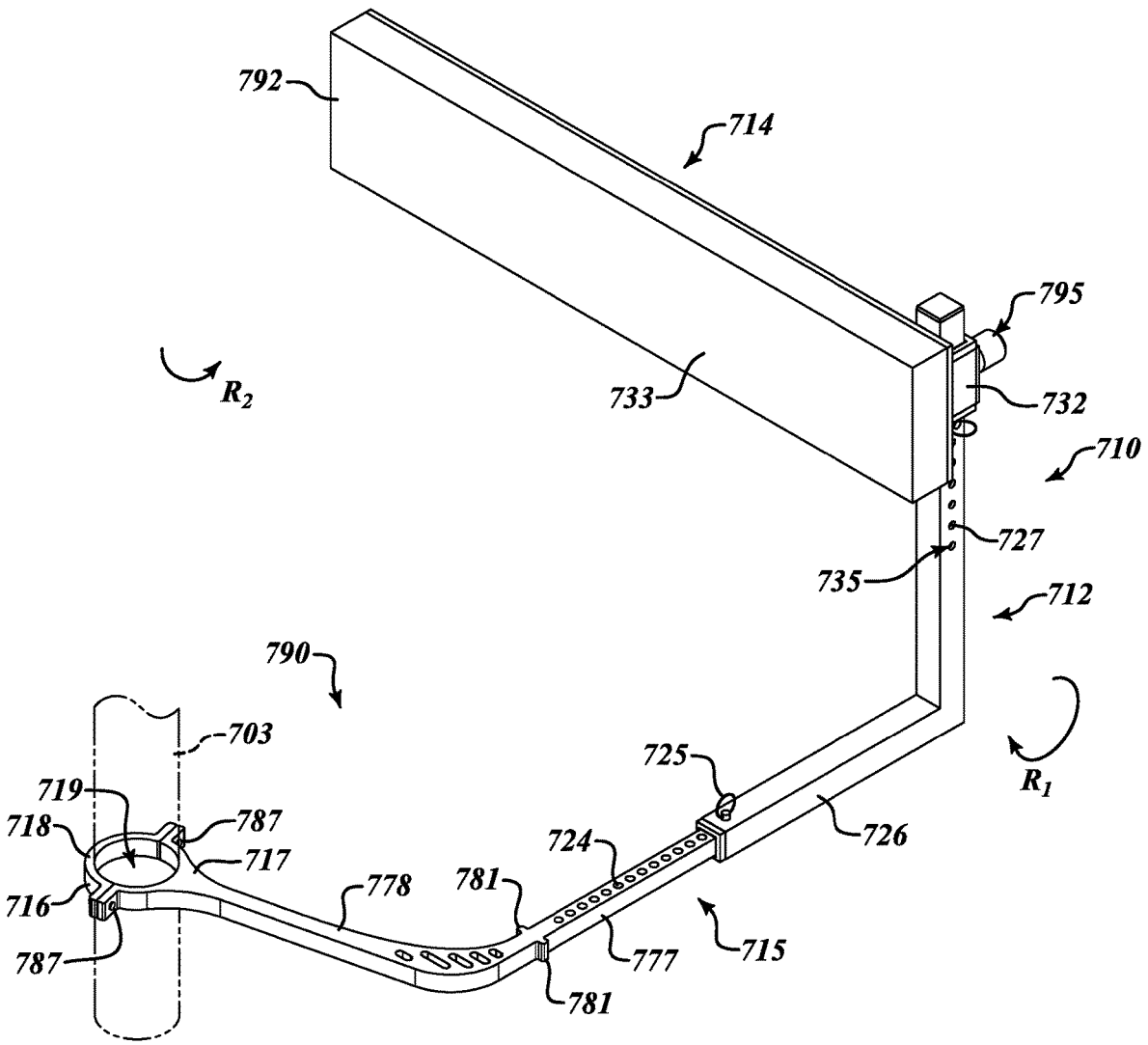
FIG. 18 is an isometric view of a chair support assembly, according to another example implementation, the chair support assembly in a fully extended configuration and a fully elevated configuration.
Figure 19:
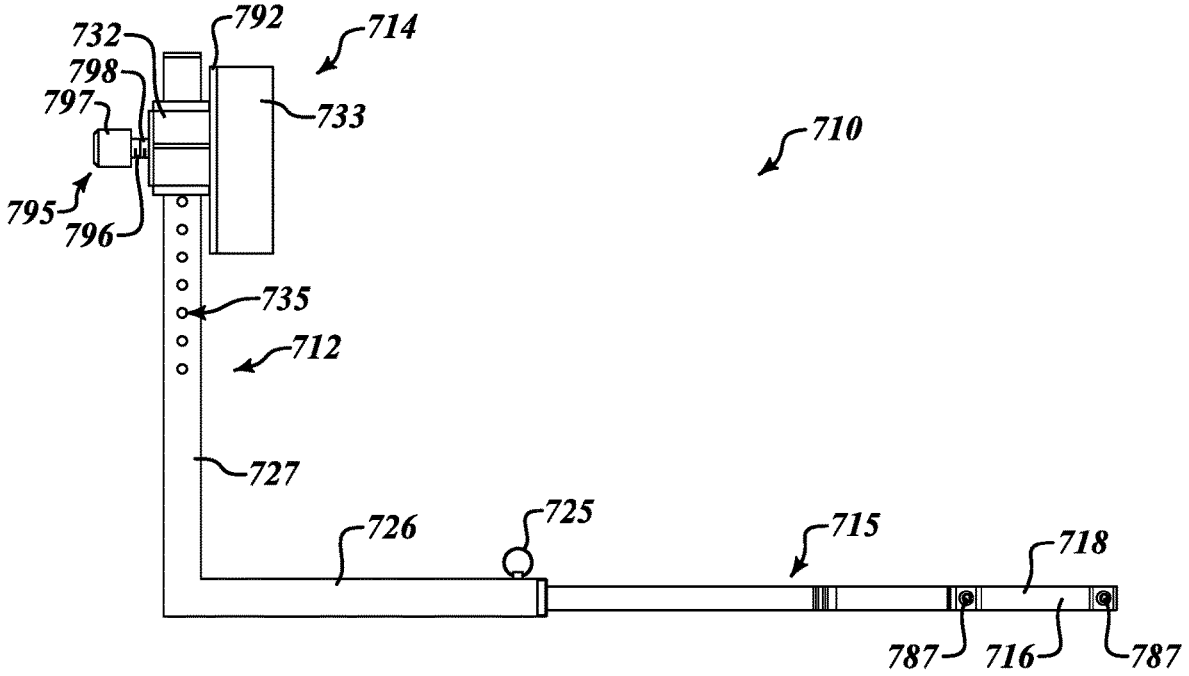
FIG. 19 is a left side view of the chair support assembly of FIG. 18.
Figure 20:
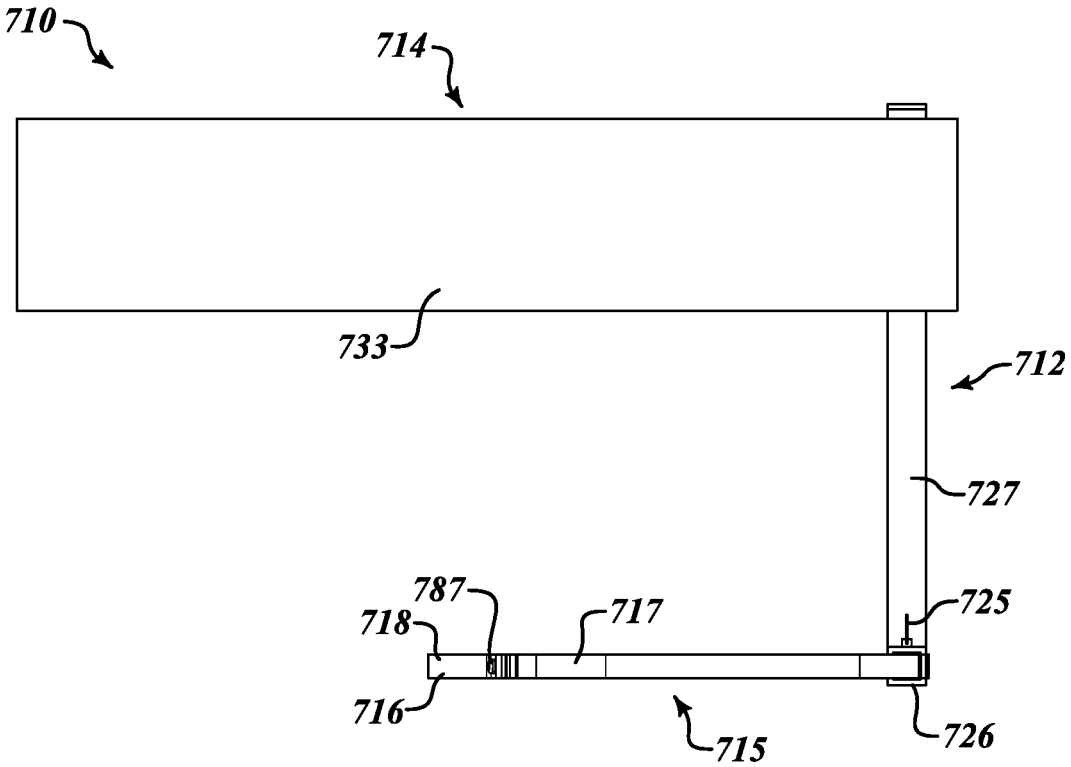
FIG. 20 is a front view of the chair support assembly of FIG. 18.
Figure 21:
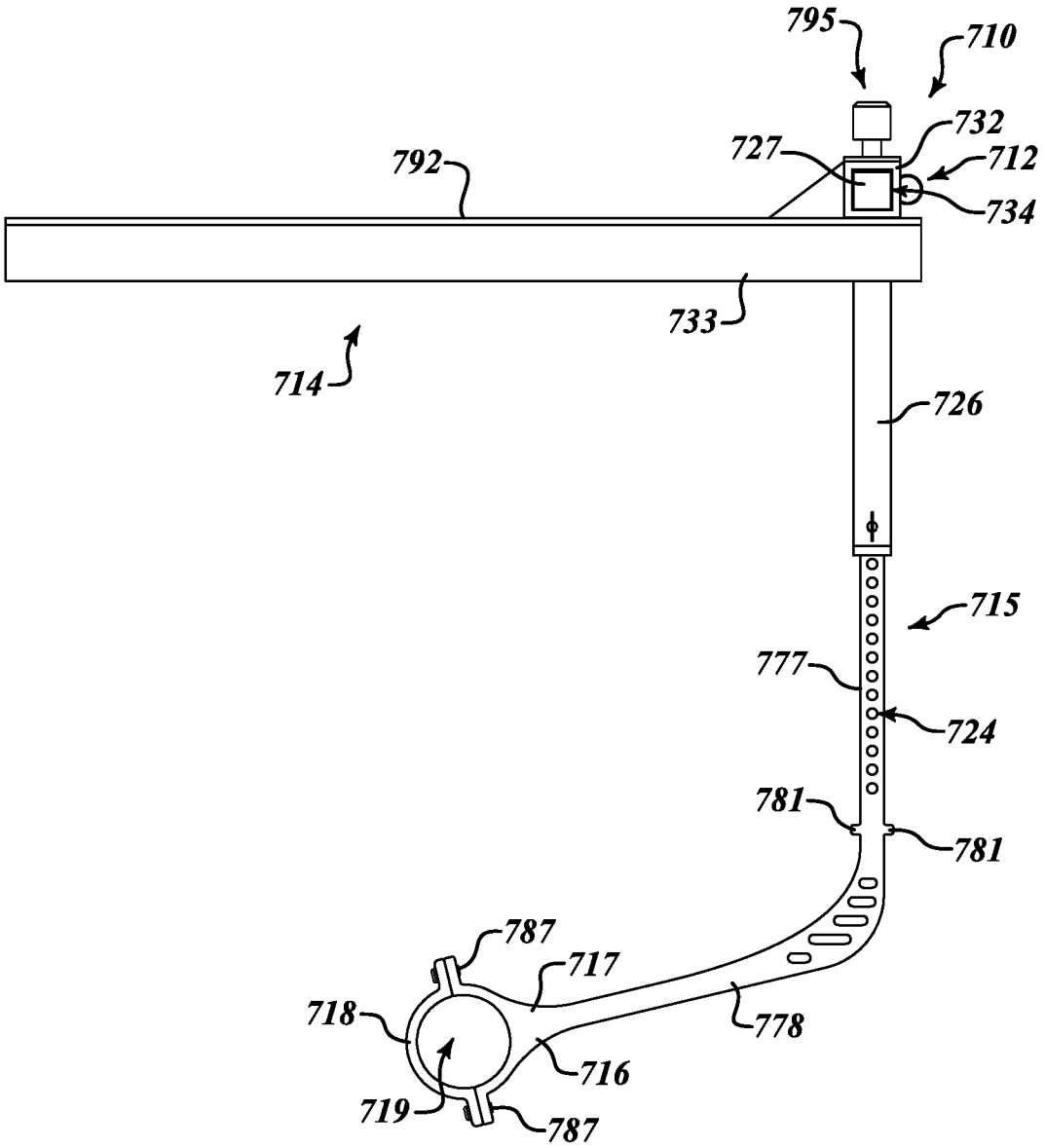
FIG. 21 is a top view of the chair support assembly of FIG. 18.

FIGS. 16 and 17 illustrate a chair support assembly 610, according to another example, non-limiting implementation, in a partially extended configuration and a partially elevated configuration. The chair support assembly 610 can be fully extended, fully retracted, fully elevated, or fully lowered similar to the implementations of the chair support assemblies described above. The chair support assembly 610 is generally similar to the chair support assembly 10 but provides certain variations. In particular, the chair support assembly includes an L-bracket assembly 612, a shin support assembly 614 adjustably coupled to the L-bracket assembly 612, an adjustable arm 615 telescopically coupled to the L-bracket assembly 612, and a clamping member 616 coupled to the adjustable arm 615.

The L-bracket assembly 612 includes a vertical bracket 627 coupled to a horizontal bracket 626. The adjustable arm 615 is adjustably coupled to the horizontal bracket 626, in that it is telescopically moveable through the horizontal bracket 626. A longitudinal adjustment pin 625, in the form of a quick pin, couples the adjustable arm 615 to the horizontal bracket 626 via one of a plurality of pin apertures. The longitudinal adjustment pin 625, however, can take other forms of the various pins described herein.

The horizontal bracket 626 at one end includes the clamping member 616 coupled thereto. The clamping member 616 includes a first portion 617 hingedly coupled to a second portion 618. The first and the second portions 617, 618 are hingedly coupled to each other to define a column aperture 619. The column aperture 619 is sized and shaped to couple to a column, for example, column 3 of a chair 1, illustrated in FIG. 1.

The shin support assembly 614 is generally configured to be rotatably moveable between open and closed positions (open position illustrated in FIGS. 16, 17). In particular, the shin support assembly 614 includes a pair of support plates 692*a*, 692*b* spaced apart from each other, each support plate 692*a*, 692*b* including a shin rest 633*a*, 633*b* coupled thereto. The shin support assembly 614 includes a mounting bracket 632, which has a body that is generally hollow with a bracket opening. The bracket opening is sized and shaped to slideably receive therein the vertical bracket 627. Moreover, in this implementation, the shin support assembly 614 is adjustably mounted to the vertical bracket 627. In particular, a vertical adjustment pin 636 is coupleably received in the vertical bracket 627 via one of a plurality of rest apertures, which set a height of the chair support assembly 610. The vertical adjustment pin 636 in this implementation takes the form of a quick pin, but can take other forms of the various pins described herein.

The shin support assembly 614 includes a rotary system 693 which allows each of the shin rests 633*a*, 633*b* to be rotatably moveable between open and closed positions. The rotary system 693 includes a pair of locking devices 694*a*, 694*b* that are located in the corresponding support plates 692*a*, 692*b*. Each locking device 694*a*, 694*b* includes a corresponding lever 695*a*, 696*b*. Each lever 695*a*, 695*b* includes a shaft member 696*a*, 696*b* that extends through the corresponding support plate 692*a*, 692*b*.

The rotary system 693 includes a plate member 697 that is fixedly coupled to the mounting bracket 632. Each shaft member 696*a*, 696*b* is removably coupled to the support plates 692*a*, 692*b* via apertures disposed therein. Biasing members, for example, springs, urge the shaft members 696*a*, 696*b* toward the support plates 696*a*, 696*b*, so that the shaft members 696*a*, 696*b* are received in the apertures of the plate member 697. In this manner, a user may move the levers 695*a*, 695*b* away from the plate member 697 to overcome biasing forces of the biasing members to remove or decouple the shaft members 696*a*, 696*b* from the plate member 697, thus allowing the shin rests 633*a*, 633*b* to be rotatably moved.

In particular, the rotary system 693 includes a pair of hinge brackets 698*a*, 698*b*. Each hinge bracket 698*a*, 698*b* includes a flange that is coupled to corresponding support plates 692*a*, 692*b*, and another flange that is coupled to the mounting bracket 632, with a hinge portion coupling the flanges. In this manner, each shin rest 633*a*, 633*b* can be rotatably moved from the open position (FIGS. 16, 17) by actuating or moving the levers 695*a*, 695*b* to decouple the shaft members 696*a*, 696*b* from the plate member 697. Thereafter, shin rest 633*a* can be moved in a first rotary direction R1 to the closed position and shin rest 633*b* can be moved in a second rotary direction R2 to the closed position. Conversely, to open the shin rests 633*a*, 633*b*, shin rest 633*a* can be rotated in the second rotary direction R2 toward the vertical bracket 627, and shin rest 633*b* can be rotated in the first rotary direction R1 toward the vertical bracket 627. As the biasing members urge the shaft members 696*a*, 696*b* toward the plate member 697, when the apertures disposed in the plate member 697 are aligned with the shaft members 696*a*, 696*b*, the shin rests 633*a*, 633*b* can be secured into the open position.

While one implementation of a rotary system 693 has been described above that permits the shin rests 633*a*, 633*b* to be rotatably moveable between open and closed positions, other mechanisms, orientations, and implementations that permit rotatability of shin rests 633*a*, 633*b*, are within the scope of the disclosed subject matter.

Figure 22:
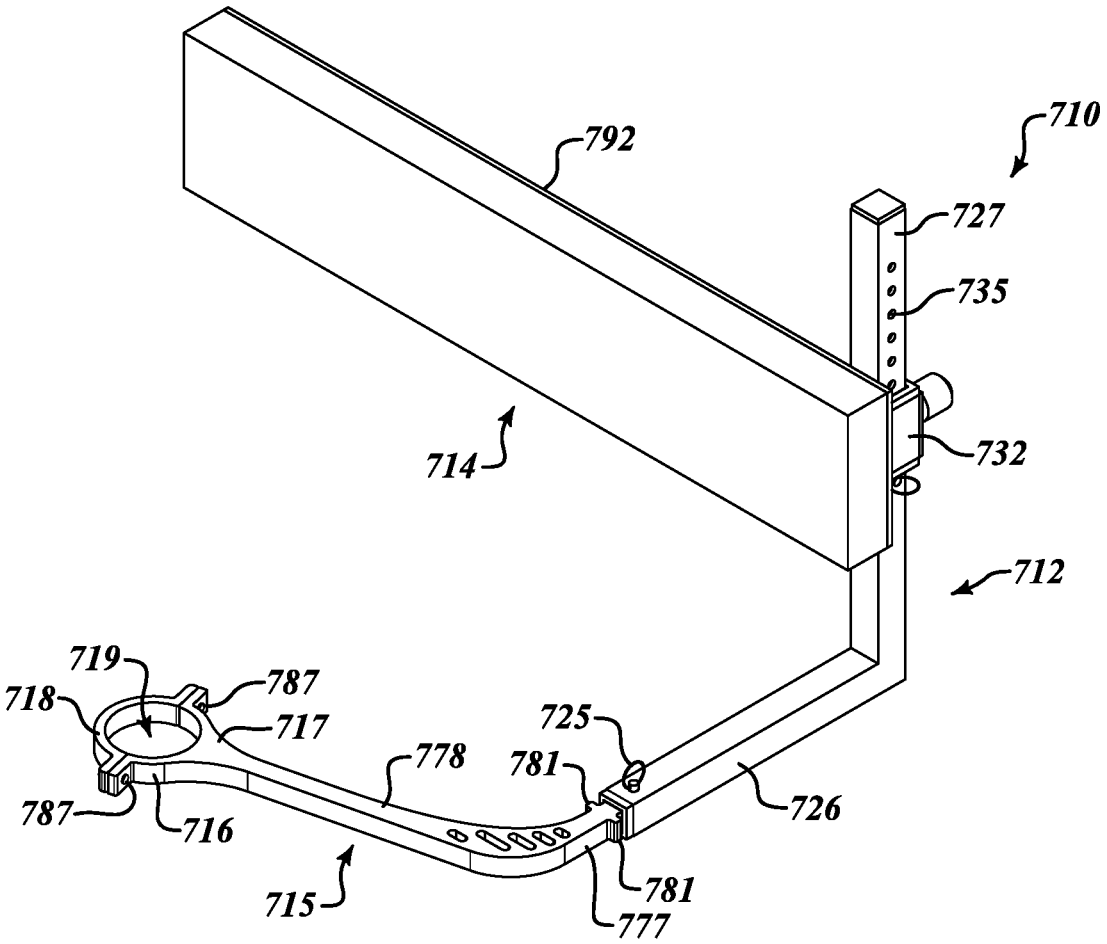
FIG. 22 is an isometric view of the chair support assembly of FIG. 18, the chair support assembly in a retracted configuration and a lowered configuration.
Figure 23:
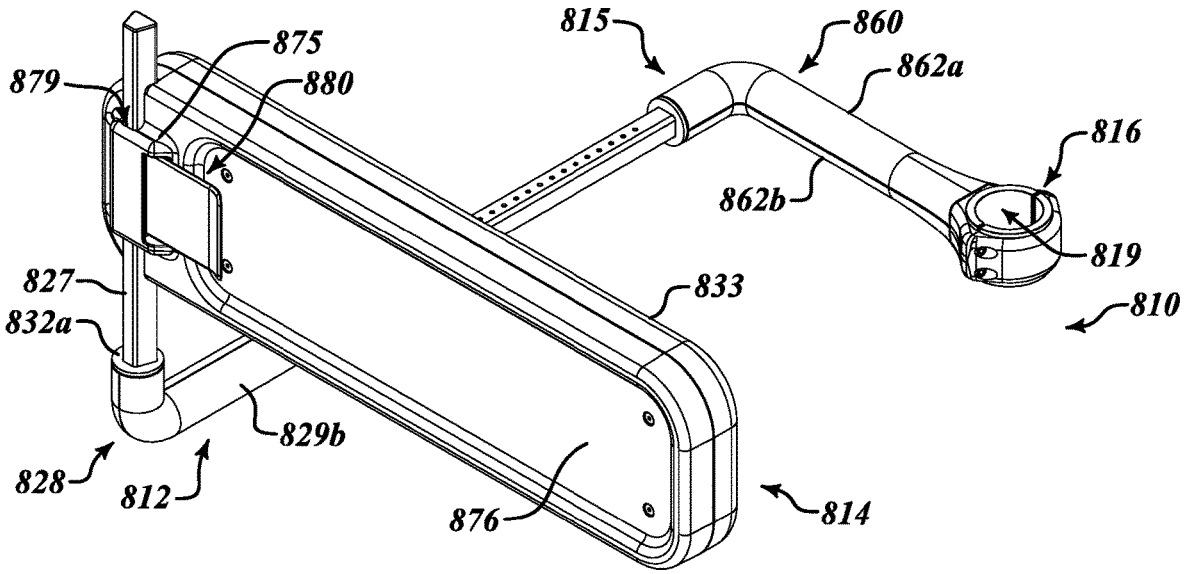
FIG. 23 is a rear isometric view of a chair support assembly, according to another example implementation, the chair support assembly in a fully extended configuration and a partially elevated configuration.
Figure 24:
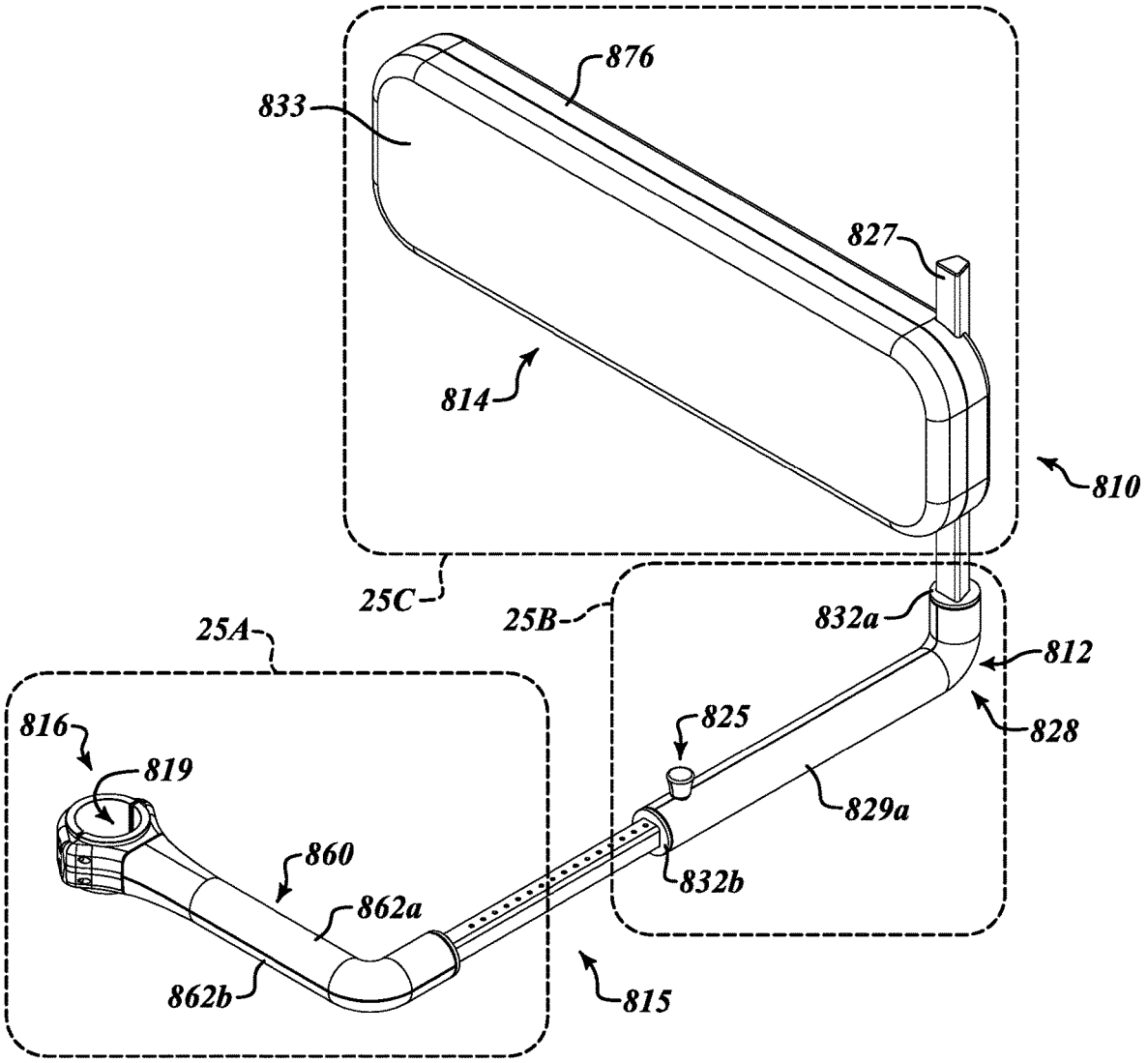
FIG. 24 is a front isometric view of the chair support assembly of FIG. 23.

FIGS. 18-22 illustrate a chair support assembly 710, according to another example, non-limiting implementation, in a fully extended configuration and a fully elevated configuration. The chair support assembly 710 can be fully extended, fully retracted, fully elevated, or fully lowered similar to the implementations of the chair support assemblies described above. For example, FIGS. 18-21 illustrate the chair support assembly 710 in the fully extended and elevated configuration, while FIG. 22 illustrates the chair support assembly 710 in the fully retracted and fully lowered configuration. The chair support assembly 710 is generally similar to the chair support assembly 710 but provides certain variations.

In particular, the chair support assembly 710 includes includes an L-bracket assembly 712, a shin support assembly 714 adjustably coupled to the L-bracket assembly 712, an adjustable arm assembly 715 telescopically coupled to the L-bracket assembly 712, and a clamping member 716 coupled to the adjustable arm assembly 715.

The L-bracket assembly 712 includes a vertical bracket 727 and a horizontal bracket 726. As illustrated in FIGS. 18-22, the horizontal bracket 726 extends horizontally relative to the vertical bracket 727 in an orthogonal direction. The L-bracket assembly 712 provides a variation, in that, the vertical bracket 727 is offset laterally from a center of the shin support assembly 714.

The shin support assembly 714 includes a mounting bracket 732 coupled to a support plate 792 and a shin rest 733, with the shin rest 733 coupled to the support plate 792. The mounting bracket 732 has a body that is generally hollow with a bracket opening 734. The bracket opening 734 is sized and shaped to slideably receive therein the vertical bracket 727. In this implementation, the mounting bracket 732 is adjustably coupled to the vertical bracket 727 via a pin 795 that takes the form of a plunger pin. The plunger pin is generally a spring-loaded pin that biasingly secures the mounting bracket 732 to the vertical bracket 727. A shaft portion 798 of the pin 795 includes a biasing device 796, such as a spring mounted thereon, and a head portion 797 of the pin 795 allows the pin to be adjustably removed to adjust vertical length of the shin support assembly 714. The shaft portion 798 of the pin 795 is coupleably received in one of the rest apertures 735.

Moreover, in this implementation, the shin support assembly 714 also optionally includes a vertical adjustment pin 736 that is coupleably received in the vertical bracket 727 via one of the rest apertures 735, which, along with the pin 795 set a height of the chair support assembly 710. For example, the optional vertical adjustment pin 736 may be positioned to be received in a rest aperture 735 immediately below the mounting bracket 732 that may serve as a stop as the mounting bracket 732 rests against the vertical adjustment pin 736 when a desired height of the chair support assembly 710 is selected. The vertical adjustment pin 736 in this implementation takes the form of a quick pin, but can take other forms of the various pins described herein.

The adjustable arm 715 is adjustably coupled to the horizontal bracket 726, in that it is telescopically moveable through the horizontal bracket 726. A longitudinal adjustment pin 725, in the form of a quick pin, couples the adjustable arm 715 to the horizontal bracket 726 via one of a plurality of arm apertures 724 disposed in the adjustable arm 715. The longitudinal adjustment pin 725, however, can take other forms of the various pins described herein.

As illustrated in FIGS. 18-22, the adjustable arm 715 provides a variation in that it has a substantially arcuate shape. The arcuate shape allows for the chair support assembly 710 to be offset laterally relative to a column 703 of a chair to define a feet resting region 790. The feet resting region 790 is sized and shaped to provide a region wherein the feet of a user can be positioned such that the shins of the user are rested against the shin support assembly 714. More particularly, the feet resting region 790 allows for the chair support assembly 710 to be rotatably moved about the column 703 of the chair via the clamping member 716. For example, when the chair support assembly 710 is coupled to the column 703 of the chair, the user may rotate the chair support assembly 710 in a first rotary direction R1 such that the shin support assembly 714 is rotated away from the shins of the user. In this manner, the chair support assembly 710 may be moved to allow the user ease of moving away from the chair. Conversely, the chair support assembly 710 may be rotatably moved in a second rotary direction R2 to bring the shin support assembly 714 toward the shins of the user during use. Thus, in this manner, this implementation of the chair support assembly 710 can facilitate ease of access to and away from the chair during use.

As described above, the adjustable arm 715 includes a plurality of spaced apart arm apertures 724 that are each sized and shaped to receive the longitudinal adjustable pin 725 to couple the adjustable arm 715 to the horizontal bracket 726. The arcuate shape of the adjustable arm 715 is defined by a first arm portion 777 that is generally parallel to the horizontal bracket 726 and includes the arm apertures 724, and a second arm portion 778 that extends angularly relative to the first arm portion 777. The first arm portion 777 includes a pair of stop tabs 781 that protrude outwardly from a body of the first arm portion 777. The stop tabs 781 operate as stops and rest against the horizontal bracket 726 when the adjustable arm 715 is in a fully retracted position as illustrated in FIG. 22.

The second arm portion 778 at one end includes the clamping member 716 coupled thereto. The clamping member 716 includes a first portion 717 coupled to a second portion 718. The first and the second portions 717, 718 are coupled to each other to define a column aperture 719. The column aperture 719 is sized and shaped to couple to the column 703, for example, column 3 of a chair 1, illustrated in FIG. 1.

The chair support assembly 710 is rotatably moveable about the column 703 in rotary directions R1, R2, as described above, to provide access to the fee resting region 790. The first and second portions 717, 718 are adjustably and removably coupled to the column 703 via a pair of pins 787. Thus, in use, a user can coupled the chair support assembly 710 to the column 703 via pin 787. The user can thereafter rotatably move the chair support assembly 710 about the column to provide access to the feet resting region 790.

FIGS. 23-29A illustrate a chair support assembly 810, according to another example, non-limiting implementation, in a fully extended configuration and a partially elevated configuration. The chair support assembly 810 can be fully extended, fully retracted, fully elevated, or fully lowered similar to the implementations of the chair support assemblies described above, but includes certain variations described in more detail below.

In particular, the chair support assembly 810 includes an L-bracket assembly 812, a shin support assembly 814 adjustably coupled to the L-bracket assembly 812, an adjustable arm assembly 815 telescopically coupled to the L-bracket assembly 812, and a clamping member 816 coupled to the adjustable arm assembly 815.

The L-bracket assembly 812 includes a vertical rail plate 827 and an elbow assembly 828. The elbow assembly 828 includes a pair of elbow covers 829*a* 829*b*, a guide assembly 830, an elbow bracket 831, and a pair of end plates 832*a*, 832*b*. The elbow covers 829*a*, 829*b* are sized and shaped to be coupled to each other. In some embodiments, the elbow covers 829*a*, 829*b* may comprise plastic; for example, plastic formed by injection molding in a single shot or multi-shot process. The elbow covers 829*a*, 829*b* when coupled to each other overlay and cover the various components of the guide assembly 830.

The guide assembly 830 includes a pair of guide brackets 891*a*, 891*b* spaced apart from each other to define a guide rail cavity 833. The guide brackets 891*a*, 891*b* are spaced apart from each other by a first rail bracket 834 and a second rail bracket 835. Each of the first and second rail brackets 834, 835 has a substantially hat-shaped cross-sectional profile. The first rail bracket 834 includes upper tab flanges 836*a*, 836*b* and lower tab flanges 837*a*, 837*b* that extend outwardly to define recesses 838*a*, 838*b* to receive corresponding guide brackets 891*a*, 891*b*. Similarly, the second rail bracket 835 includes upper tab flanges 892*a*, 892*b* and lower tab flanges 840*a*, 840*b* that extend outwardly to define recesses 841*a*, 841*b* to receive corresponding guide brackets 891*a*, 891*b*. The guide assembly 830 also includes a sleeve 843. The sleeve 843 includes a sleeve opening 844 that is sized and shaped to slideably receive the adjustable arm assembly 815 as will be described in more detail below. A quick pin aperture 845 is disposed in the sleeve 843. The quick pin aperture 845 is sized and shaped to coupleably receive a longitudinal adjustment pin 825. The longitudinal adjustment pin 825 can take a wide variety of forms and shapes and can be similar to any of the adjustment pins described above. For example, in some implementations, the longitudinal adjustment pin 825 can include a shaft portion 851 that is spring loaded and received through the quick pin aperture 845.

Figure 25A:
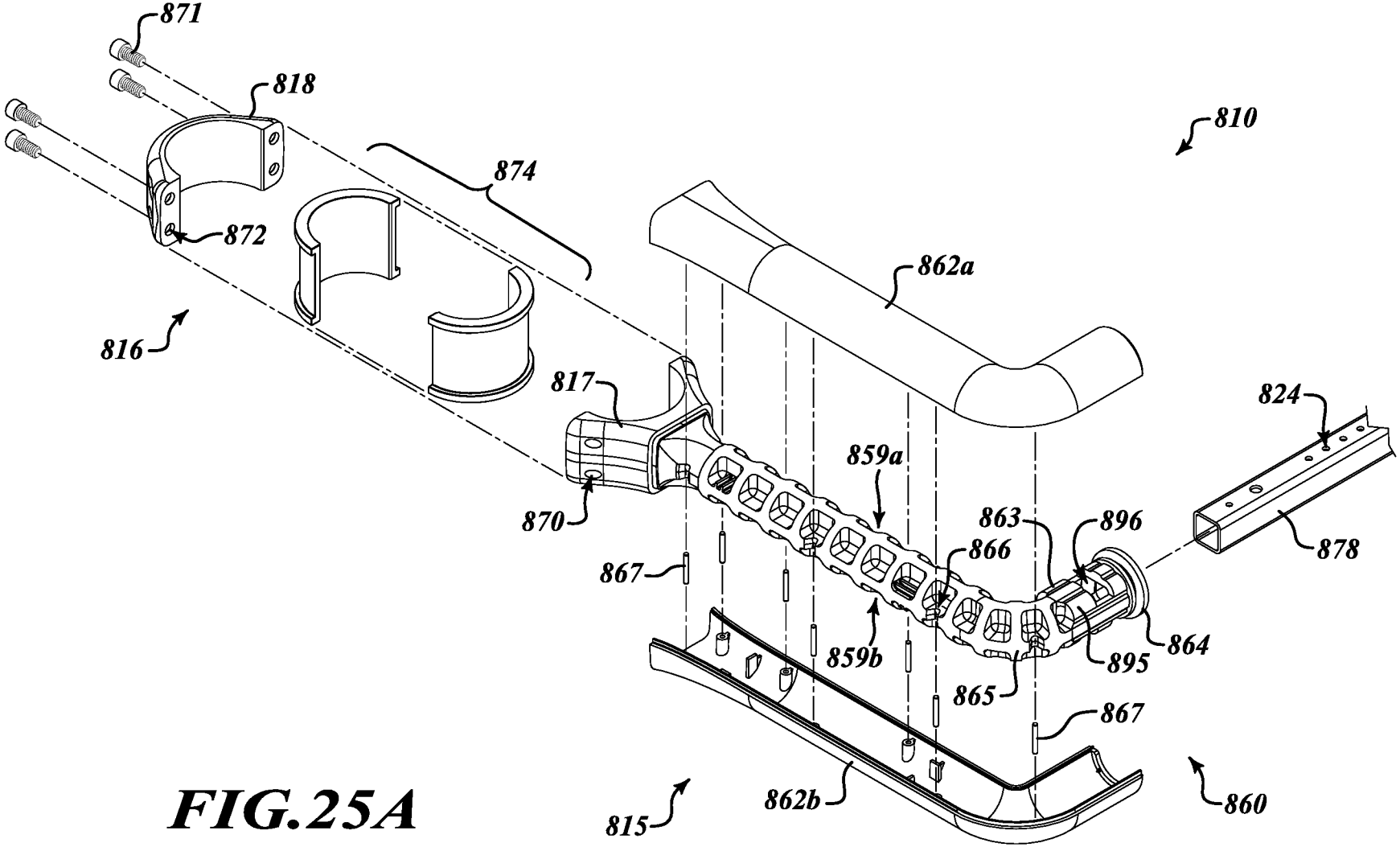
FIG. 25A is an exploded view of portions of the chair support assembly of FIG. 23.
Figure 25B:
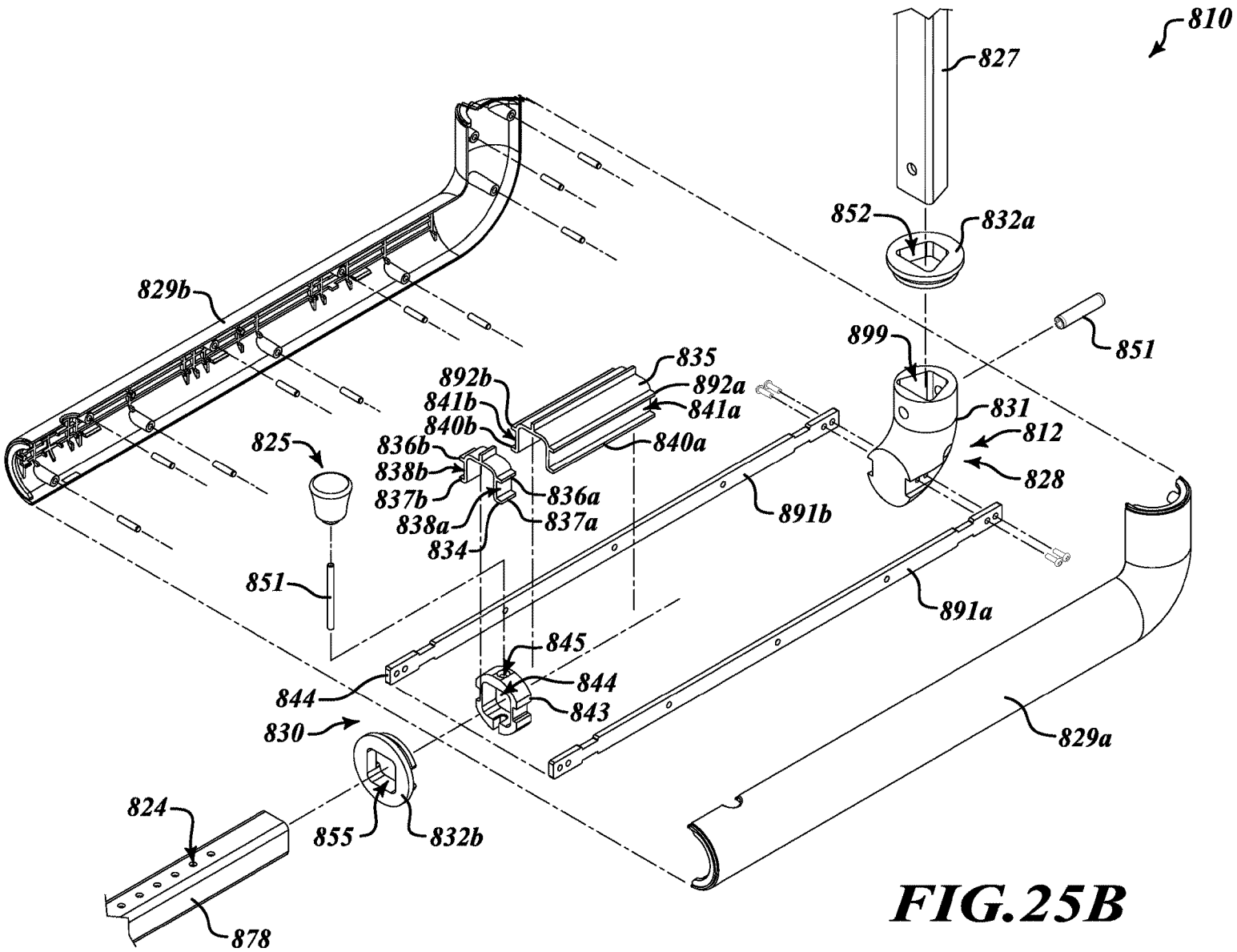
FIG. 25B is another exploded view of portions of the chair support assembly of FIG. 23.
Figure 25C:
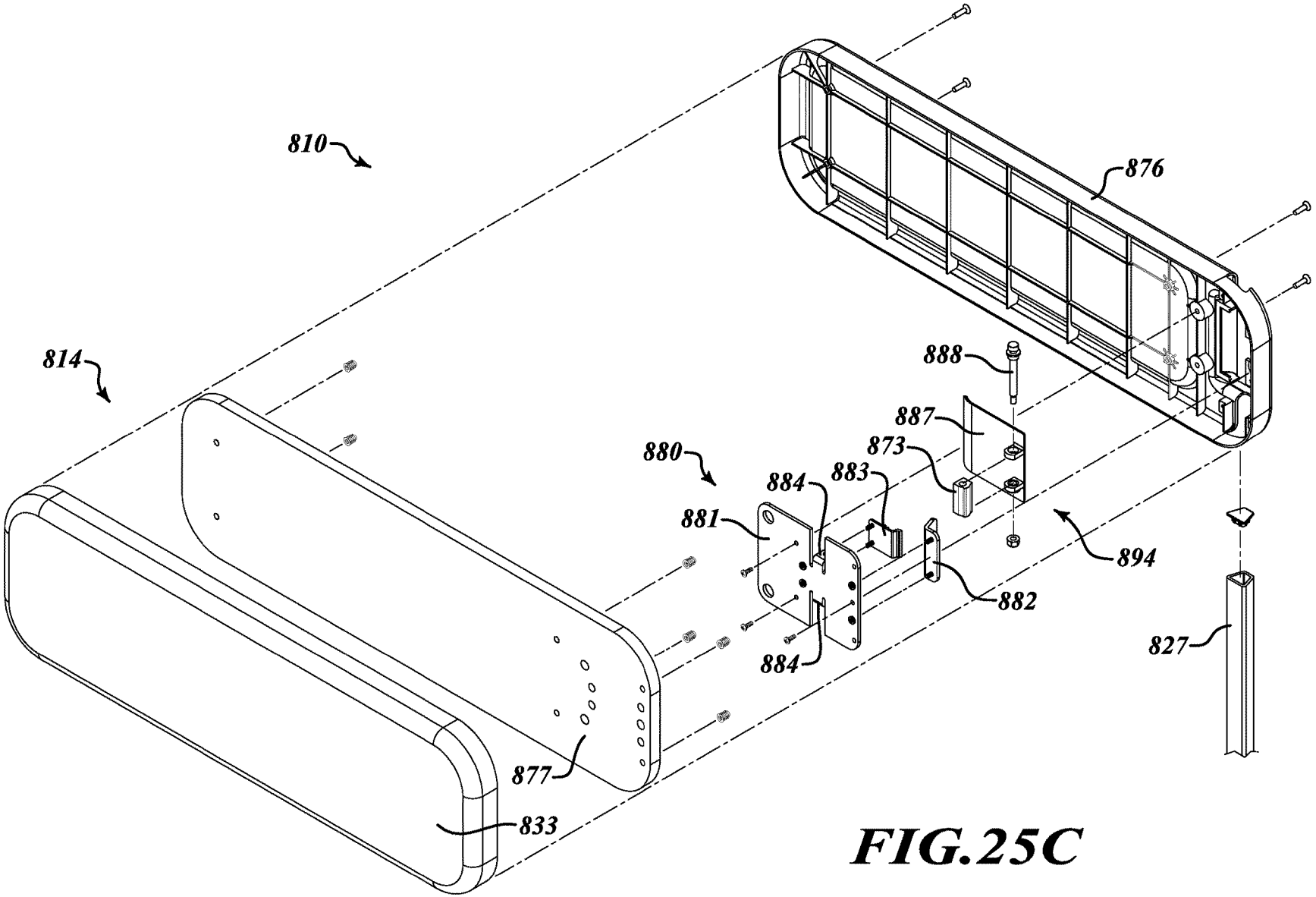
FIG. 25C is another exploded view of portions of the chair support assembly of FIG. 23.
Figure 26:
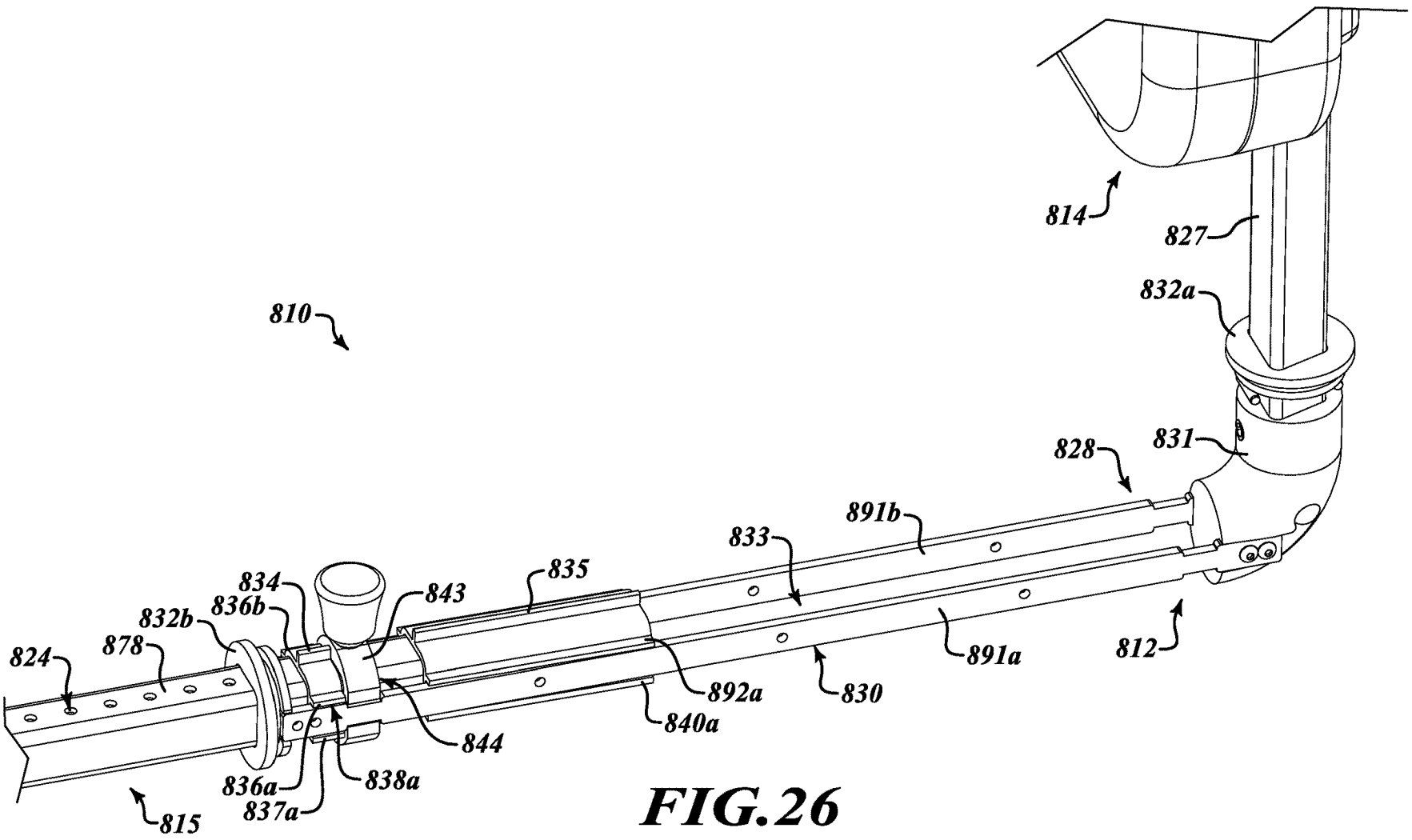
FIG. 26 is a partial isometric view of the chair support assembly of FIG. 23, with certain components, e.g., elbow covers, removed for clarity of illustration and description.
Figure 27:
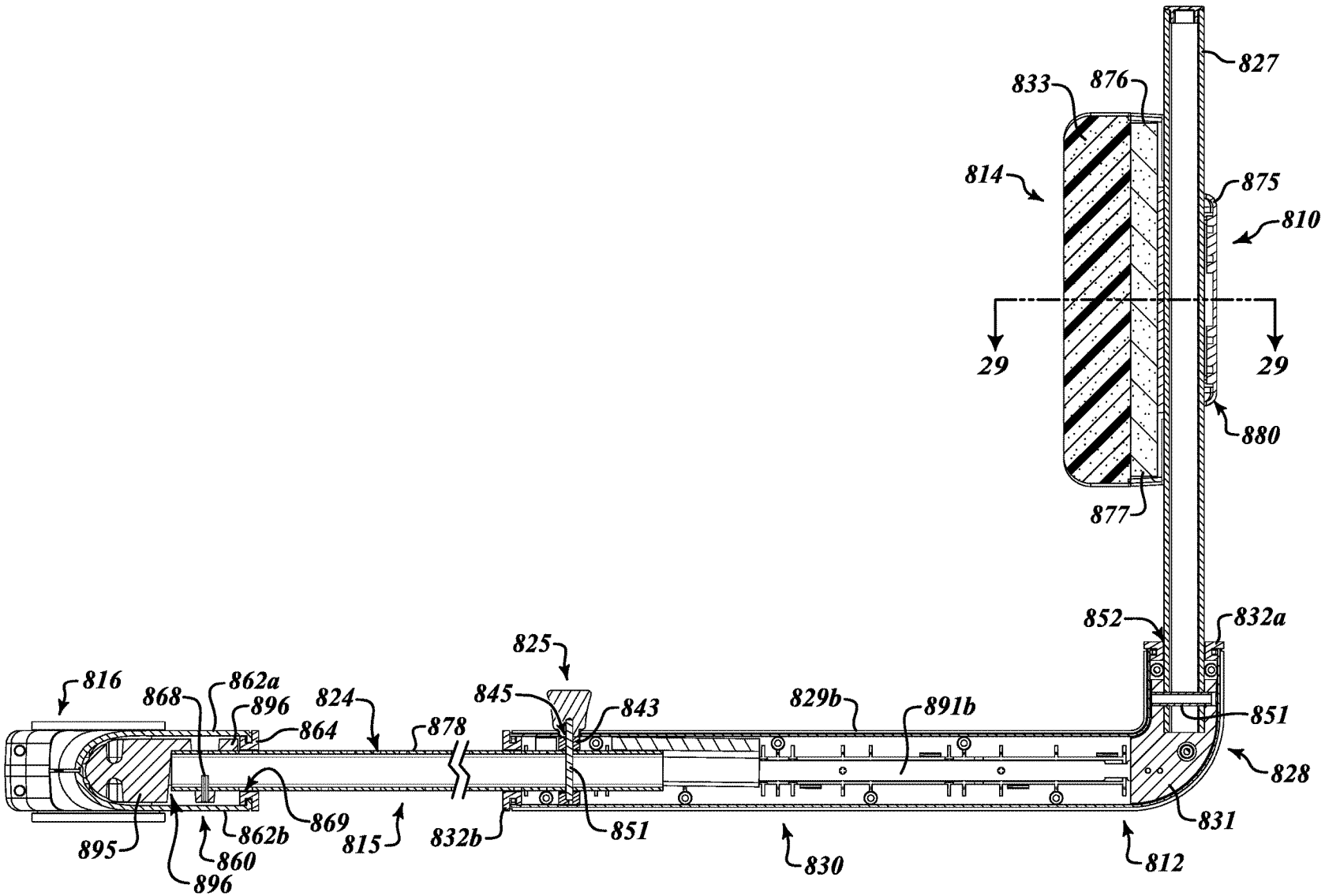
FIG. 27 is a cross-sectional view of the chair support assembly of FIG. 23, taken along line 27-27.

The elbow bracket 831 is coupled to ends of the guide brackets 891*a*, 891*b* at or near one end of the elbow bracket 831. At another end, the elbow bracket 831 is coupled to end plate 832*a*. As illustrated in FIGS. 25B, 26, and 27 in detail, the elbow bracket 831 includes a vertical plate aperture 899 and the end plate 832*a* also includes a vertical plate aperture 852. The vertical plate aperture 899 of the elbow bracket 831 and the vertical plate aperture 852 of the end plate 832*a* are both sized and shaped to coupleably receive the vertical rail plate 827. The end plate 832*b* is also coupled to ends of the guide brackets 891*a*, 891*b* and includes an arm portion aperture 855. The arm portion aperture 855 is sized and shaped to slideably receive the adjustable arm assembly 815. In particular, the guide rail cavity 833, the sleeve opening 844, and the arm portion aperture 855 are sized and shaped to collectively slideably receive therethrough an arm portion 878 of the adjustable arm assembly 815. The arm portion 878 when received through the sleeve opening 844 and the arm portion aperture 855 is guided and aligned via the spacing of the guide brackets 891*a*, 891*b* and the hat-shaped cross-sectional profile of the first and second rail brackets 834, 835.

When the L-bracket assembly 812 is assembled, the elbow covers 829*a*, 829*b* are coupled to each other and at opposing ends thereof, to the end plates 832*a*, 832*b*. The vertical rail plate 827 is fixedly coupled to the end plate 832*a* and the elbow bracket 831. The longitudinal adjustment pin 825 is moveably and removeably coupled to the L-bracket assembly 812.

As described above, the adjustable arm assembly 815 includes the arm portion 878. The arm portion 878 includes a plurality of arm apertures 824. As illustrated in FIGS. 23-29A, the adjustable arm assembly 815 is movably and telescopically received in the L-bracket assembly 812. In the adjustable arm assembly 815 in particular, the arm portion 878 can be adjustably coupled to the L-bracket assembly 812 in a longitudinal direction via the longitudinal adjustment pin 825. In this implementation, the adjustable pin 825 is in the form of a quick pin, but can take other forms of adjustable pins described above. In particular, a longitudinal length of the chair support assembly 810 can be adjusted by coupling the longitudinal adjustment pin 825 to the arm portion 878 via one of the arm apertures 824.

Figure 28:
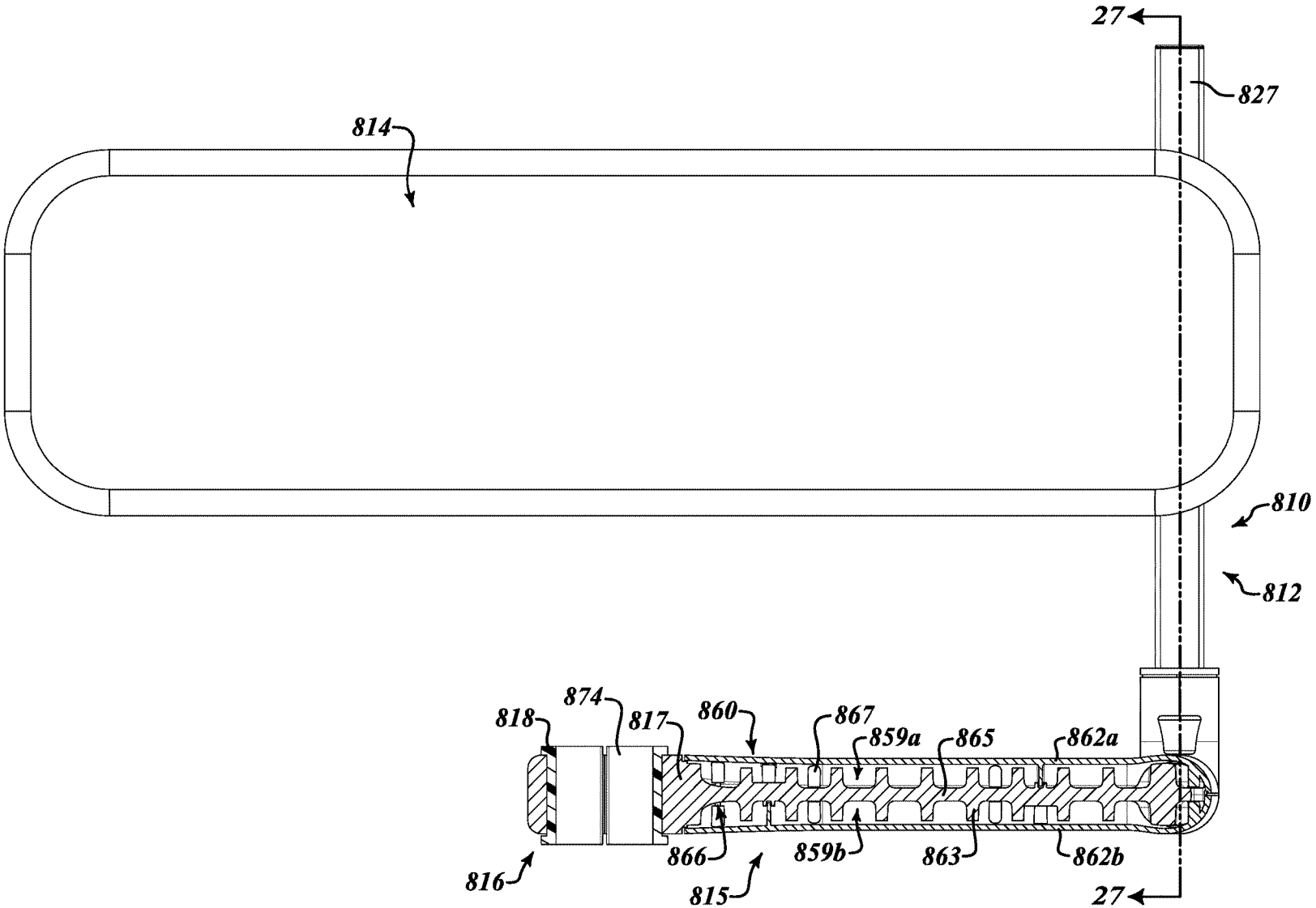
FIG. 28 is a cross-sectional view of the chair support assembly of FIG. 23, taken along line 28-28
Figure 29:
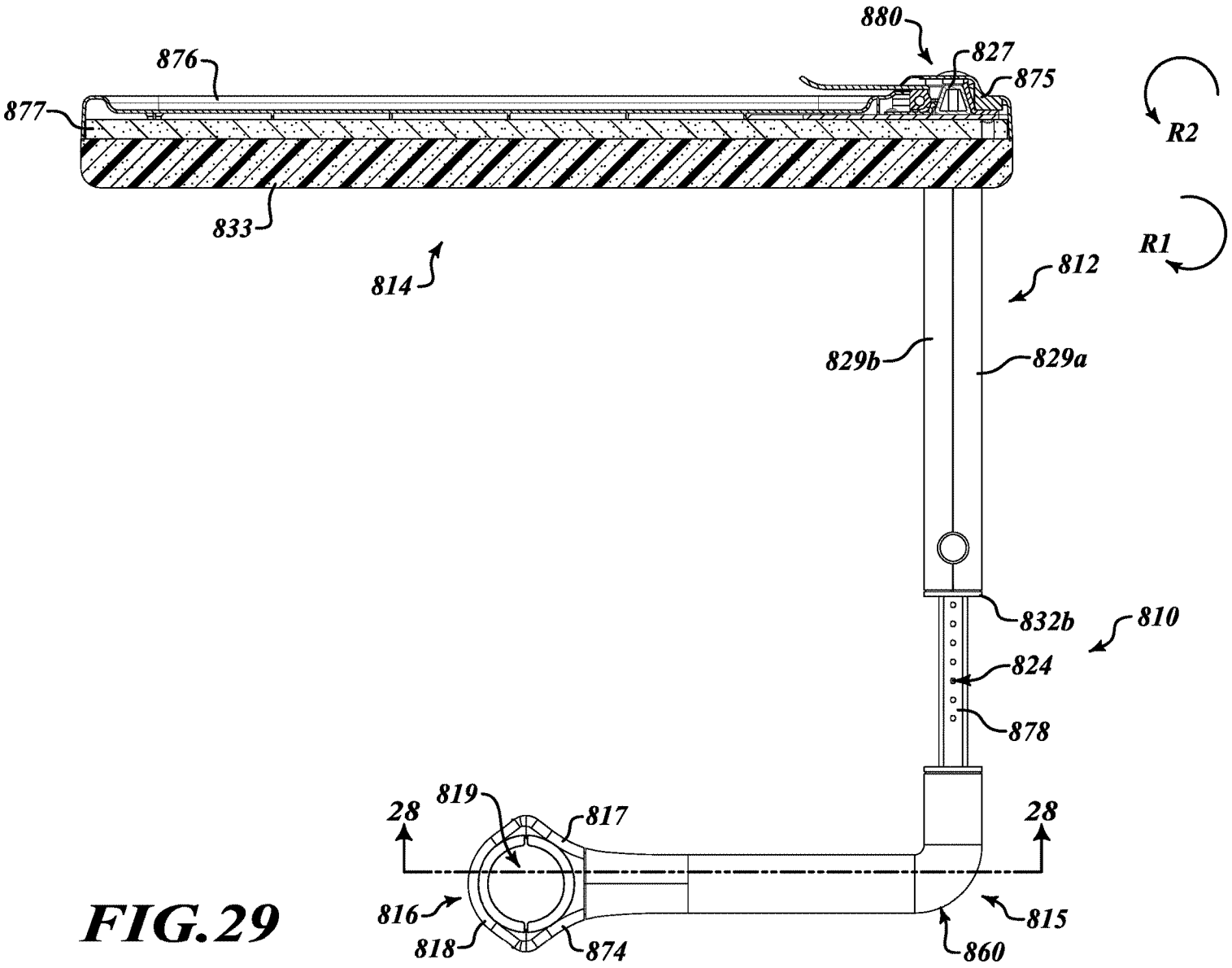
FIG. 29 is a cross-sectional view of the chair support assembly of FIG. 23, taken along line 29-29.
Figure 29A:
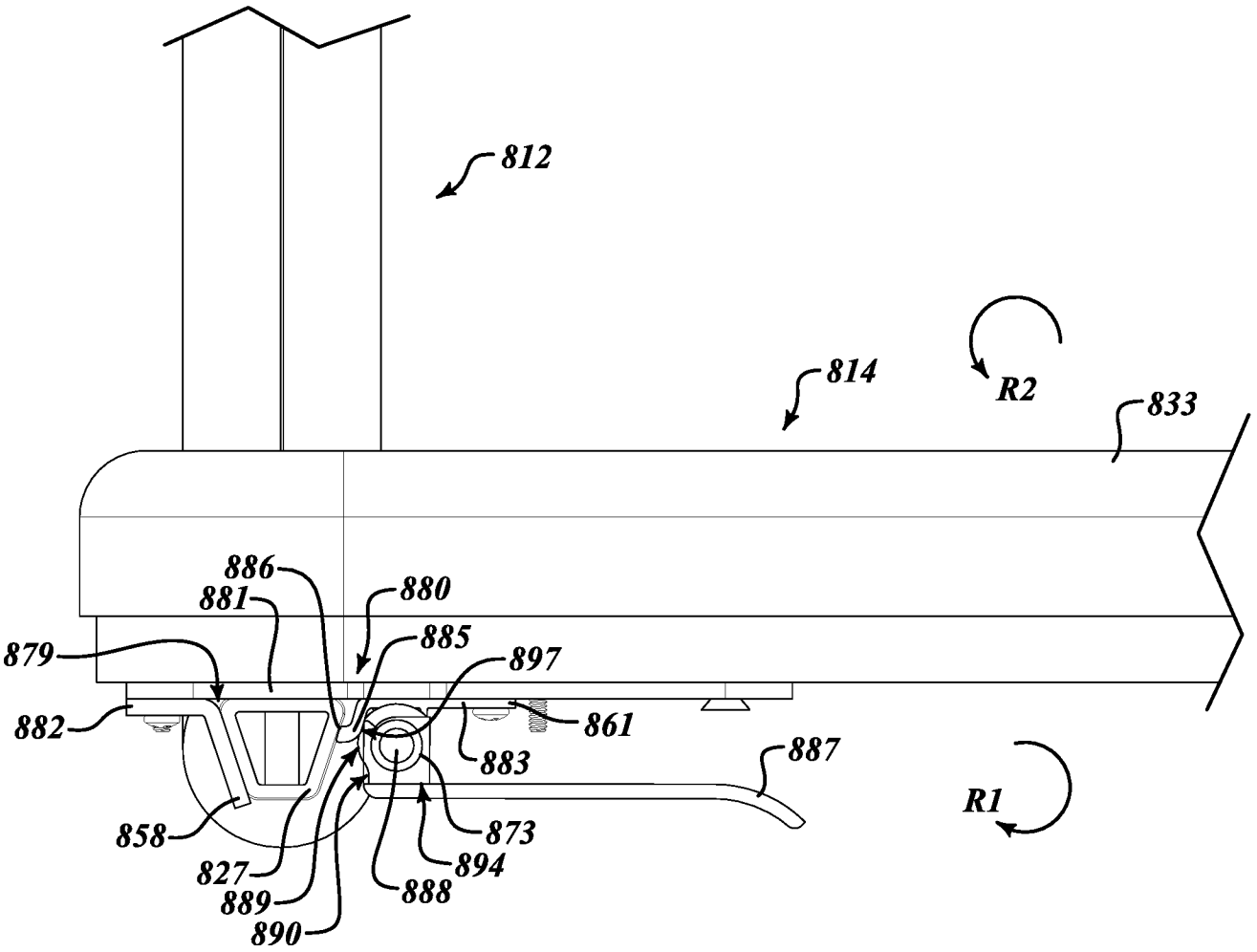
FIG. 29A is a partial detail view of the cross-sectional view of FIG. 29.

The adjustable arm assembly 815 further includes a swing arm assembly 860 coupled to the arm portion 878. The swing arm assembly 860 includes a pair of swing arm covers 862*a*, 862*b*, a swing plate 863, a swing end plate 864. The swing arm covers 862*a*, 862*b* have a substantially L-shaped structural profile and, in some implementations, comprise plastic; for example, plastic formed by injection molding in a single shot or multi-shot process. The swing arm covers 862*a*, 862*b* are sized and shaped to couple to each other. The swing plate 863 generally comprises a metallic structure and is sized and shaped to withstand various loads and weights of users; for example, in some implementations, the swing plate 863 can be fabricated via machining, casting, or other suitable processes and methods. The swing plate 863 includes a plurality of spaced apart upper recesses 859*a* and lower recesses 859*b* that are spaced apart from each other. As illustrated in FIGS. 25A and 28 in detail, upper and lower recesses 859*a*, 859*b* define a plurality of ribs 865. The ribs 865 are sized and shaped to provide structural strength to the chair support assembly 810. For example, the ribs 865 are optimally sized and shaped to reduce the overall weight footprint of the chair support assembly 810 while providing capability to the chair support assembly 810 to withstand loads and/or weights of up to 250 pounds. The swing plate 863 further includes one or more pin recesses 866. The pin recesses 866 are sized and shaped to receive therethrough pins 867 that couple the swing arm covers 862*a*, 862*b* to the swing plate 863.

At or near one end, the swing plate 863 includes a coupling portion 895. The coupling portion 895 includes a first arm portion cavity 896. The arm portion cavity 896 is sized and shaped to receive therethrough the arm portion 878. The coupling portion 895 is fixedly coupled to the arm portion 878 via an arm portion pin 868. As illustrated in FIG. 27 in detail, the swing end plate 864 includes a second arm portion cavity 869 that is sized and shaped to receive therethrough the arm portion 878. The swing end plate 864 is coupled to the swing plate 863 and the swing arm covers 862*a*, 862*b*, with the swing plate 863 extending therethrough.

At another end, the swing plate 863 includes a clamping portion 817 that has a substantially C-shaped cross-sectional profile. The clamping portion 817 includes one or more clamping apertures 870. The clamping portion 817 is coupled to a first clamping portion 818 of the clamping member 816 via one or more clamping fasteners 871. In this implementation, the clamping member 816 is formed by the clamping portion 817 of the swing plate 863 and the first clamping portion 818. The first clamping portion 818 also includes one or more clamping portion apertures 872 extending therethrough. The one or more clamping portion apertures 872 are sized and shaped to receive the one or more clamping fasteners 871 to couple the clamping portion 817 to the first clamping portion 818. When the clamping portion 817 is coupled to the first clamping portion 818, such defines a column aperture 819. The column aperture 19 is sized and shaped to couple to a column 3 of a chair 1, as illustrated in FIG. 1.

In some implementations, the clamping member 816 includes an optional guard cover 874. The guard cover 874 may, in some implementations, comprise plastic; for example, plastic formed by injection molding in a single shot or multi-shot process. The guard cover 874 is received in the column aperture 819 and coupled to the first clamping portion 818 and the clamping portion 817.

The shin support assembly 814 includes a shin pad 833, an inner cover 876, and a backing plate 877. The shin pad 833 and the inner cover 876 sandwich the backing plate 877. In some implementations, the inner cover 876 may comprise plastic (for example, plastic formed by injection molding in a single shot or multi-shot process), while the backing plate 877 may comprise metal or wood. The shin pad 833 may comprise rubber, polyurethane material, or other soft materials comprising various polymers. The backing plate 877, in general, is sized and shaped to provide structural support and strength to prevent undesired flexing of the shin support assembly 814.

As illustrated in FIGS. 23-29A, the inner cover 876 includes a coupling element 875 protruding outwardly from an external surface. The coupling element 875 includes a vertical plate recess 879 that is sized and shaped to slideably receive therethrough the vertical rail plate 827. In this manner, the shin support assembly 814 may be slideably moved to adjust the chair support assembly 810 between fully elevated and fully lowered configurations.

The shin support assembly 814 includes a locking assembly 880 that is operable to lock and unlock the shin support assembly 814 to reach a desired elevation. The locking assembly 880 includes a backer bracket 881, a first lock bracket 882, a second lock bracket 883, and a cam-lock assembly 894. The back bracket 881 is coupled to the backing plate 877 via one or more fasteners. The backer bracket 881 includes a pair of cam tabs 884 that protrude outwardly to define a cam receiving cavity. The first lock bracket 882 is coupled to the backer bracket 881 and generally includes an L-shaped cross-sectional profile with a lock flange 858 that abuts against the vertical rail plate 827.

The second lock bracket 883 includes a base flange 861 that is coupled to the backer bracket 881 and an upstanding flange 885 that protrudes outwardly from the base flange 861 and has an arcuate shape having a mating surface 897 and an end portion 886.

The cam-lock assembly 894 includes a cam member 873, a cam lever 887, and a cam pin 888. The cam member 873 is coupled to the cam lever 887 and is received in the cam receiving cavity described above. The cam member 873 and the cam lever 887 are pivotably coupled to the cam tabs 884 via the cam pin 888. The cam member 873 includes a cam surface 889 and a cam recess 890. The cam surface 889 is sized and shaped to abut the mating surface 897 of the second lock bracket 883 in a locking position, and in an unlocking position, the cam member 873 is pivotably moved to position the cam recess 890 proximate to the mating surface 897. In particular, the cam lever 873 is pivotably moveable about the cam pin 888 in rotary directions R1, R2. As the cam lever 887 is moved in rotary direction R1, such causes rotary movement of the cam member 873 in rotary direction R1 and the cam recess 890 is positioned proximate to the mating surface 897 to reduce frictional forces between the cam member 873 and the second lock bracket 883. Consequently, frictional forces between the second lock bracket 883, in particular, the end portion 886 and the vertical rail plate 827 are reduced. As such, in this configuration, the shin support assembly 814 is adjustably moveable between the fully elevated and fully lowered configurations. Conversely, as the cam lever 873 is pivotably moved in rotary direction R2, such causes rotary movement of the cam member 873 in rotary direction R2 and the cam surface 889 abuts the mating surface 897 of the second lock bracket 883. Consequently, the end portion 886 is moved to contact and/or abut the vertical rail plate 827 to increase frictional forces therebetween and lock the shin support assembly 814 to the desired elevation. As such, in this configuration, the shin support assembly 814 is locked.

Thus, in use, a user can couple the clamping member 816 to the column 3 of the chair 1. The one or more clamping fasteners 871 may be unfastened to uncouple the first clamping portion 818 from the clamping portion 817 of the swing plate 863, and the column 3 may be received in the optional guard cover 874. Thereafter, the one or more clamping fasteners 871 may fasten the first clamping portion 818 to the clamping portion 817 of the swing plate 863. The longitudinal length of the chair support assembly 810 can be adjusted by slideably, telescopically moving the adjustable arm assembly 815 until a desired longitudinal positioning is reached, at which point the longitudinal adjustment pin 825 can secure the arm portion 878 to the L-bracket assembly 812. Thereafter, as desired, the vertical length of the chair support assembly 810 can be adjusted. In particular, the cam lever 887 may be rotated in rotary direction R1, and the shin support assembly 814 can be moved until a desired position of the shin rest 833 is reached, where the user's shins are supported by the shin rests 833. Thereafter, the cam lever 887 can be pivotably rotated in rotary direction R2 to lock the shin support assembly 814.

Moreover, the various embodiments or implementations described above can be combined to provide further embodiments or implementations. These and other changes can be made to the embodiments or implementations in light of the above-detailed description. For example, in some embodiments, the various arm portions of the adjustable arms described herein may be removably coupleable to other components of the chair arm support assemblies. For example a first arm portion (e.g., first arm portion 777, arm portion 878, etc.) may be adjustably coupleable to L-bracket assemblies (e.g., L-bracket assembly 712, 812, etc.) and removably or fixedly coupleable to a second arm portion (e.g., second arm portion 778, swing arm assembly 860, etc.) via various coupling structures, such as round, hollow tubes, elbows, or other coupling structures. In general, in the following claims, the terms used should not be construed to limit the claims to the specific embodiments or implementations disclosed in the specification and the claims, but should be construed to include all possible embodiments or implementations along with the full scope of equivalents to which such claims are entitled. Accordingly, the claims are not limited by the disclosure.

The invention claimed is:

1. A chair support assembly coupleable to a chair comprising:

a bracket assembly having an elbow assembly and a vertical plate, the vertical plate extending from the elbow assembly at a substantially perpendicular orientation relative to the elbow assembly;

an adjustable arm telescopically coupled to the elbow assembly, the adjustable arm slideably moveable in a longitudinal direction of the chair support assembly; and a shin support assembly slideably coupled to the elbow assembly, the shin support assembly including an inner cover, a backing plate, and a shin pad that is sized and shaped to rest against a shin of a user.

2. The chair support assembly of claim 1 wherein the elbow assembly has an opening sized and shaped to slideably receive therein the adjustable arm.

3. The chair support assembly of claim 1, further comprising:

a clamping member sized and shaped to secure the adjustable arm to a column of the chair.

4. The chair support assembly of claim 1, further comprising:

a clamping member having a first portion and a second portion.

5. The chair support assembly of claim 1 wherein the adjustable arm includes a plurality of apertures that are spaced apart from each other, each of the plurality of apertures positioned to adjust a longitudinal length of the chair support assembly.

6. The chair support assembly of claim 5, further comprising:

a longitudinal adjustment pin coupled to the elbow assembly, the longitudinal adjustment pin includes a shaft portion that is sized and shaped to be coupleably received in the plurality of apertures.

7. The chair support assembly of claim 1 wherein the shin pad comprises a single, rectangular-shaped shin pad.

8. The chair support assembly of claim 1 wherein the adjustable arm includes:

an arm portion telescopically coupled to the elbow assembly;

a swing arm assembly having:

a pair of swing arm covers;

a swing plate received in the pair of swing arm covers; and a swing end plate coupled to one of the pair of swing arm covers.

9. The chair support assembly of claim 8 wherein the swing plate includes a plurality of upper recesses and a plurality of lower recesses, the upper and lower recesses sized and shaped to define ribs of the swing plate.

10. The chair support assembly of claim 8, further comprising a clamping member having a first clamping portion that is integrally formed with the swing plate and a second clamping portion that is removably coupled to the first clamping portion.

11. A method, comprising:

coupling a chair support assembly to a column of a chair, the chair support assembly including:

a bracket assembly having an elbow assembly and a vertical plate, the vertical plate extending from the elbow assembly at a substantially perpendicular orientation relative to the elbow assembly;

an adjustable arm telescopically coupled to the elbow assembly, the adjustable arm slideably moveable in a longitudinal direction of the chair support assembly; and a shin support assembly slideably coupled to the elbow assembly, the shin support assembly including an inner cover, a backing plate, and a shin pad that is sized and shaped to rest against a shin of a user;

slideably moving the adjustable arm relative to the bracket assembly to adjust the longitudinal length of the chair support assembly; and slideably moving the shin support assembly relative to the bracket assembly to adjust a vertical length of the chair support assembly, the moving positioning the shin pad of the shin support assembly adjacent to the shin of the user.

12. The method of claim 11 wherein coupling the chair support assembly to the column of the chair comprises securing the adjustable arm to the column via a clamping member.

13. The method of claim 11 wherein slideably moving the adjustable arm relative to the bracket assembly to adjust the longitudinal length of the chair support assembly further comprising securing the adjustable arm to the elbow assembly via a pin.

14. The method of claim 11 wherein slideably moving the shin support assembly relative to the bracket assembly to adjust the vertical length of the chair support assembly further comprises securing a locking assembly of the shin support assembly to vertical plate of the bracket assembly via a pin.

15. A chair support assembly coupleable to a chair comprising:

a bracket assembly having an elbow assembly and a vertical plate, the vertical plate extending from the elbow assembly at a substantially perpendicular orientation relative to the elbow assembly;

an adjustable arm telescopically coupled to the elbow assembly, the adjustable arm slideably moveable in a longitudinal direction of the chair support assembly, the adjustable arm including:

an arm portion telescopically coupled to the elbow assembly; and a swing arm assembly having:

a pair of swing arm covers;

a swing plate received in the pair of swing arm covers; and a swing end plate coupled to one of the pair of swing arm covers; and a shin support assembly slideably coupled to the elbow assembly, the shin support assembly including a shin rest that is sized and shaped to rest against a shin of a user.

* * * * *